United States Patent [19]

Ehara et al.

[11] Patent Number: 5,074,738

[45] Date of Patent: Dec. 24, 1991

[54] METHOD AND APPARATUS FOR TAKE OUT AND TRANSPORT OF UPRIGHT OBJECTS SUCH AS AMPULES FROM STORAGE/TRANSPORT CASE AND THIS CASE ITSELF

[75] Inventors: Toshiyasu Ehara; Tohru Kobayashi, both of Saitama; Masao Takada, Honjo, all of Japan

[73] Assignee: Eisai Co., Ltd., Tokyo, Japan

[21] Appl. No.: 564,584

[22] Filed: Aug. 9, 1990

[30] Foreign Application Priority Data

Aug. 18, 1989 [JP] Japan ..... 1-212554

[51] Int. Cl.[5] ..... B65B 69/00

[52] U.S. Cl. ..... 414/411; 220/4.28; 414/417; 414/786; 414/798.1

[58] Field of Search ..... 414/411, 416, 417, 414, 414/797.4, 798.1, 786; 220/4.28, 610, 617, 621; 206/530, 531, 534.1, 534.2, 540

[56] References Cited

U.S. PATENT DOCUMENTS 3,960,280 6/1976 Stolzer ..... 414/417 X
4,231,697 11/1980 Franz ..... 414/417 X
4,482,282 11/1984 Wildmoser ..... 414/417 X
4,671,722 6/1987 Ray et al. ..... 414/417 X
4,717,304 1/1988 Bocchicchio et al. ..... 414/417 X
4,911,601 3/1990 Muramatsu et al. ..... 414/417

*Primary Examiner*—David A. Bucci
*Attorney, Agent, or Firm*—Griffin, Branigan & Butler

[57] ABSTRACT

To take upright articles such as ampules out from a case for storage thereof, the case having a pair of laterally opposite side plates formed with a pair of vertical slots, respectively, which are provided with pointed protrusions, defining notches into which a shutter is removably engaged and thereby held in a posture inclined forward with respect to the transporting direction. A control device is adapted to disengage the shutter from the notches and then to engage the shutter into the other notches so as to erect the shutter. A front ejector plate is inserted into the case and the shutter is removed by a chuck from the case. A pusher plate provided on the inner side of a case rear side plate pushes the ampules forward and the rear ejector is inserted into the case. Then a device for moving the front and rear ejector plates is actuated horizontally and thereby the upright articles are transported onto a conveyor. A case feeding station is provided with a feeding conveyor and a case discharging station is adapted to discharge the empty case having completed transport of the upright articles.

15 Claims, 35 Drawing Sheets

METHOD AND APPARATUS FOR TAKE OUT AND TRANSPORT OF UPRIGHT OBJECTS SUCH AS AMPULES FROM STORAGE/TRANSPORT CASE AND THIS CASE ITSELF

BACKGROUND OF THE INVENTION

The present invention relates to method and apparatus for taking out and then transporting upright objects such as ampules from a case to other processes as for packaging and sterilization as well as to said case itself used also for said transporting.

There has been available neither any special case allowing, for example, ampules temporarily stored therein to be mechanically taken out therefrom in order to be transported to, for example, the packaging line nor any apparatus adapted for automatically feeding the ampules onto a conveyor or the like.

Accordingly, the industry relies, as before, upon the usual procedure comprising steps of storing ampules in the ordinary box or the like, manually taking them out therefrom and transferring them onto the conveyor or the like.

However, manually supplying makes it impossible to achieve an automated all flow production and thereby to realize a labor-saving.

It has been also difficult to develop an apparatus adapted to supply the ampules to other lines while maintaining them upright in view of a fact that the ampules generally have vertically long shapes being ready to fall down.

SUMMARY OF THE INVENTION

Accordingly, it is an object of the invention to take upright articles having vertically long shapes ready to fall down such as ampules not manually but mechanically out from a case within which said ampules have been temporarily stored, in easy and safe manner.

The object set forth above is achieved, in accordance with the invention, by a method for taking upright articles such as ampules out from a case, said method comprising steps of:

1) inserting front and rear ejector plates into the case for storage of the upright articles such as the ampules, said case having a pair of laterally opposite side plates formed with a pair of vertical slots, respectively, into which a shutter is removably engaged;
2) removing the shutter from said case;
3) laterally moving said front and rear ejector plates toward conveying means such as a conveyor; and
4) removing said front and rear ejector plates from said case for storage of the upright articles such as the ampules after these ejector plates have been moved to their positions above said conveying means such as the conveyor.

As technical means for implementation of this method, the invention provides an apparatus for taking out and conveying of upright articles such as ampules from a case, said apparatus comprising:

the case for storage of the upright articles such as the ampules, said case having a pair of laterally opposite side plates formed with a pair of vertical slots, respectively, into which a shutter is removably engaged;

front and rear ejector plates adapted to be removably inserted into said storage case;

a chuck used to remove said shutter from said case;

means for laterally moving said front and rear ejector plates; and means for conveyance of said upright articles such as the ampules.

EFFECT OF THE INVENTION

The invention provides an effect as set forth below:

A) The respective ejector plates inserted into the case hold the ampules stored therein from front and rear so that the ampules are neither scattered out nor fall down even after the shutter has been pulled out by the chuck.

B) The respective ejector plates thus holding the ampules from front and rear allow the ampules to be held upright during transport out of the case, so a mechanical transport of the ampules having been considered to be difficult is thereby achieved. In this manner, automated flow production is realized and substantial labor-saving is achieved.

C) The vertical slots of the case for storage of the upright articles such as the ampules are provided with front and rear notches defined by intermediate pointed protrusions, respectively, so that the shutter may be held inclined forward in a direction of conveyance by engaging said shutter into the respective appropriate notches. After the ampules have been stored in the case with the shutter held inclined forward in this manner, the shutter may be shifted from engagement with said notches into engagement with the other notches and thereby oriented vertically to obtain a gap between the shutter and the adjacent ampules. This gap assures that the front ejector plate can be smoothly lowered to hold the ampules without damaging the ampules. Concerning the rear ejector plate, the rear side plate of the case is provided on its inner side with a pusher plate adapted to push the ampules forward so that, by pushing this pusher plate forward, the ampule can be shifted forward to obtain a gap sufficient for smoothly lowering the rear ejector plate to hold the ampules without damaging the ampules.

D) During the step of removing the front and rear ejector plates from the case for storage of the upright articles such as the ampules, the rear ejector plate may be removed in the first place, then the front ejector plate may be removed secondary and the front ejector plate may be moved at a velocity higher than that for the conveying means such as the conveyor to assure that there occurs no friction among the front ejector plate, the rear ejector plate and the ampules. Accordingly the ampules can be transported without a possibility of falling down.

Furthermore, by providing said technical means with a case feeding station having a feeding conveyor to feed said cases for storage of the upright articles such as the ampules and a case discharging station for discharging said cases for storage of the upright articles such as the ampules which have completed task of feeding and have been emptied, it is achieved that the upright articles such as the ampules can be efficiently taken out of the cases and transported by the conveying means such as the conveyor wherein operation of both taking out and transport can be performed not manually but mechanically.

As has previously been mentioned, the laterally opposite side plates of the case for storage of the upright articles such as the ampules are preferably provided with a pair of vertical slots, respectively, adapted for removably receiving the shutter.

BRIEF DESCRIPTION OF THE DRAWINGS

The above and other objects of the invention will be seen by reference to the description taken in connection with the accompanying drawings, in which:

FIG. 4 is a perspective view showing a case used to convey ampules or the like;

DETAILED DESCRIPTION OF THE INVENTION

Figure 1:
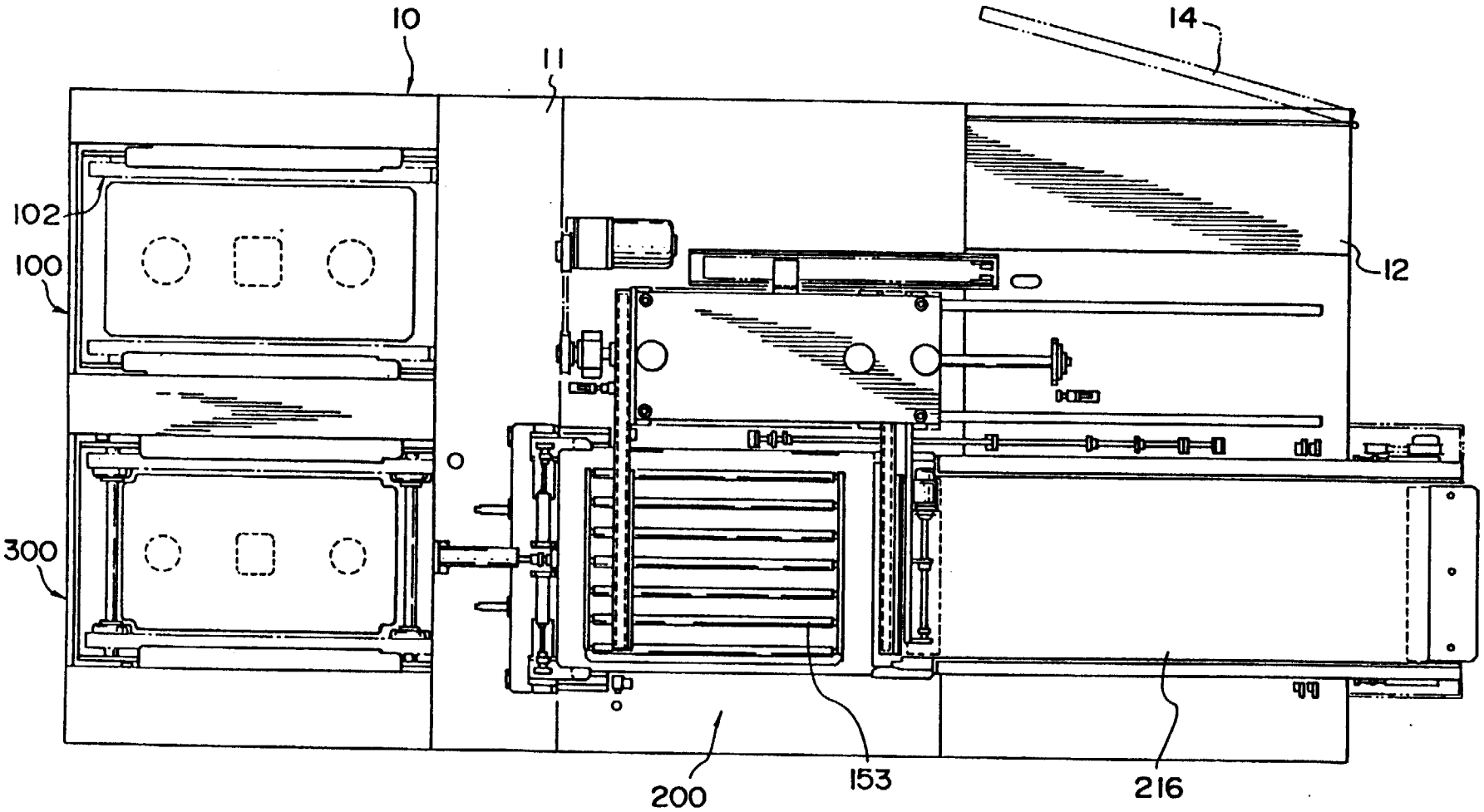
FIG. 1 is a plan view showing a complete supply apparatus in one embodiment of the invention.
Figure 2:
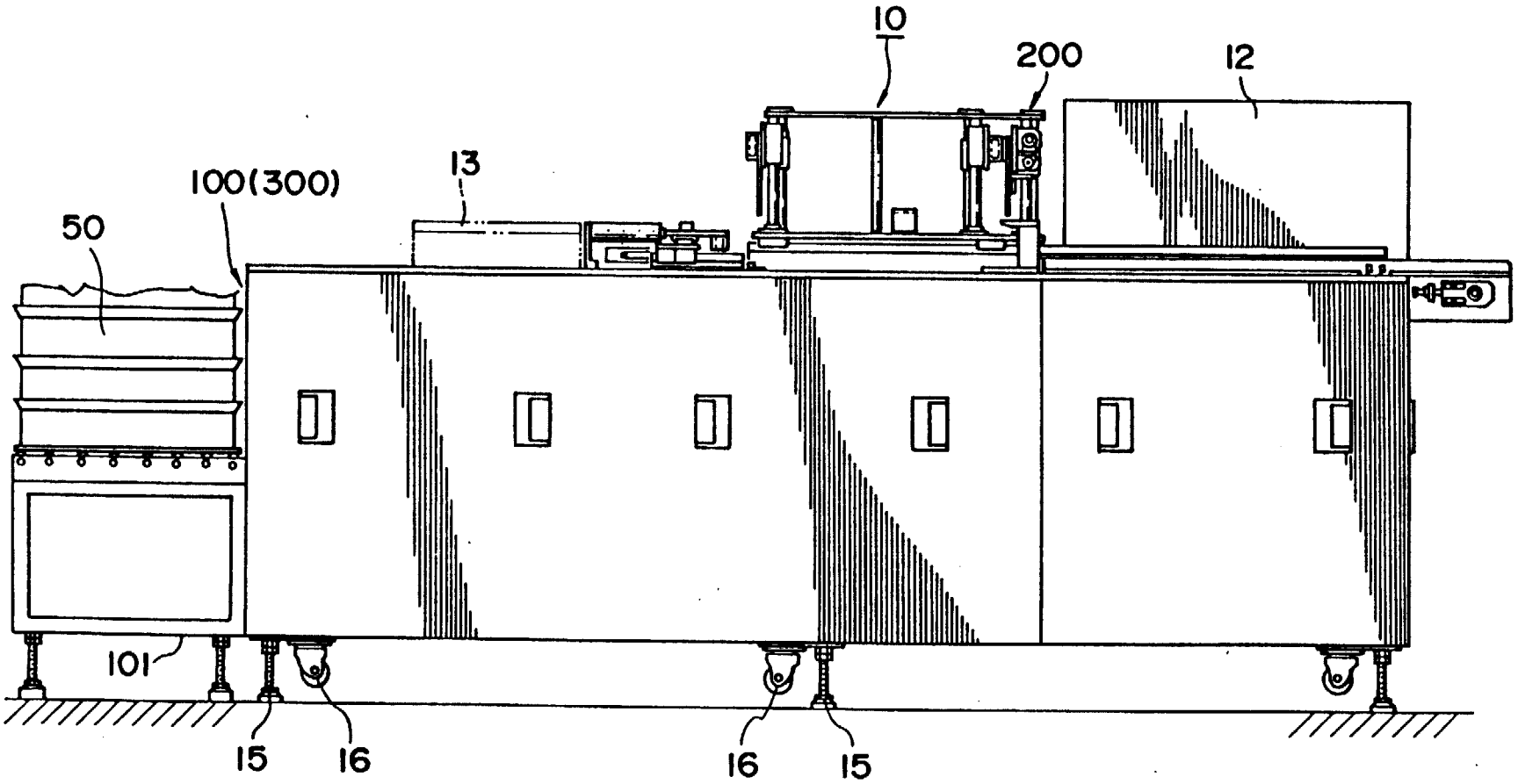
FIG. 2 is a front view corresponding to FIG. 1.
Figure 3:
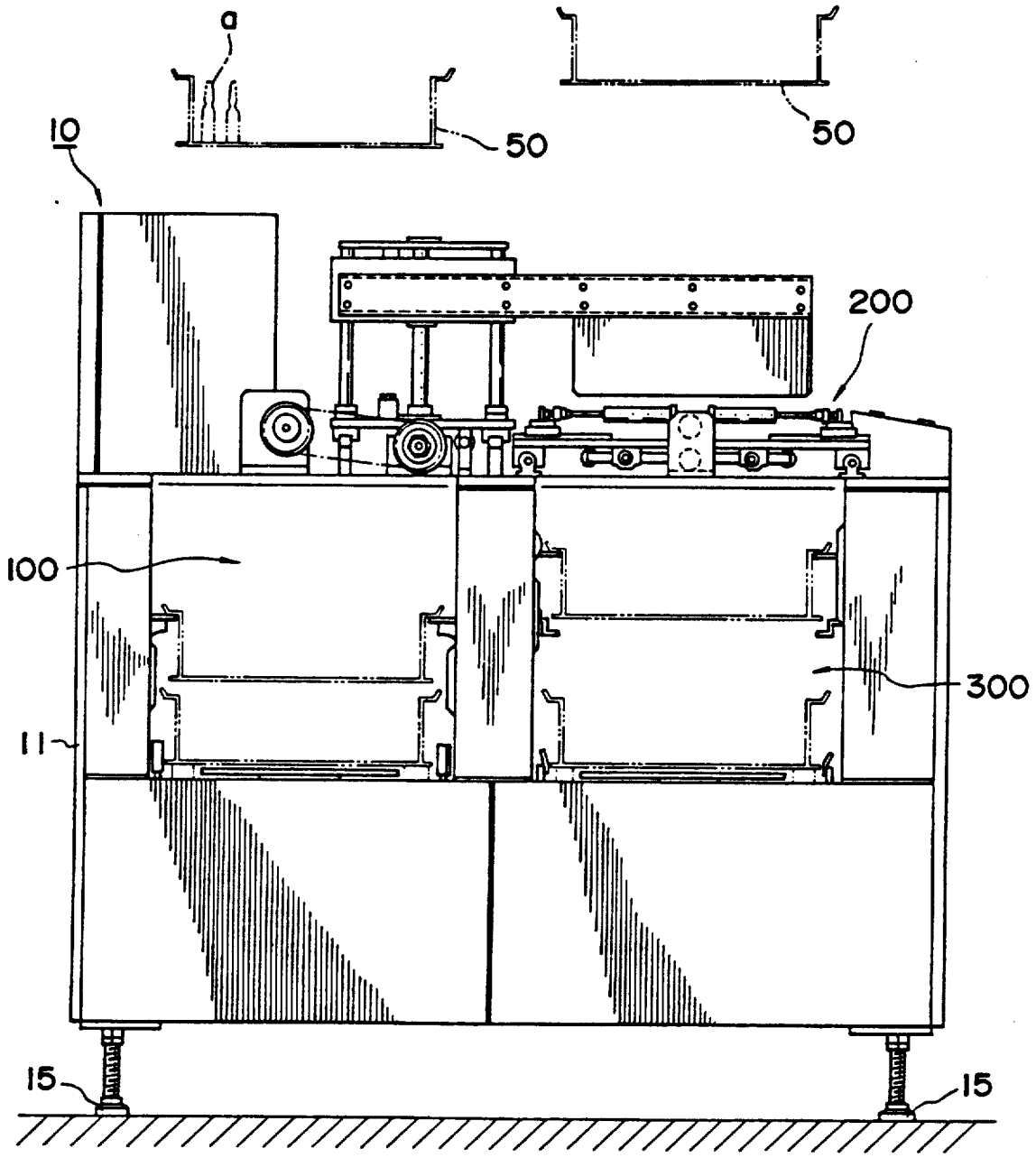
FIG. 3 is a left side view corresponding to FIG. 1.

The present invention will be described more in details by way of example with respect to the accompanying drawings. FIG. 1 is a plan view showing a supply apparatus of the invention designated generally by reference numeral 10, FIG. 2 is a front view and FIG. 3 is a left side view thereof, respectively.

The supply apparatus 10 comprises an apparatus proper 11, a control unit 12 and an operating box 13. The control unit 12 is selectively opened and closed by a door 14. The apparatus proper 11 is normally supported by support legs 15 and can be easily position-shifted using casters 16, as required.

Reference numeral 50 designates a case filled with a plurality of ampules (a) arranged in an orderly manner. These cases 50 are successively introduced one by one from a stack thereof through a case feeding station 100 into the apparatus proper 11 as shown in FIG. 2. Each of the cases 50 is horizontally moved through the apparatus proper 11 and then vertically moved toward a bottom of an ampule supply station 200. Now the case 50 is lifted by a lifter 153 into the ampule supply station 200 where the ampules (a) are taken out from this case 50 and transported onto a conveyor 216. The case 50 thus emptied is lowered by the lifter 153, then moved horizontally and discharged through a case discharging station 300.

First of all, the case 50 will be discussed.

Figure 4:
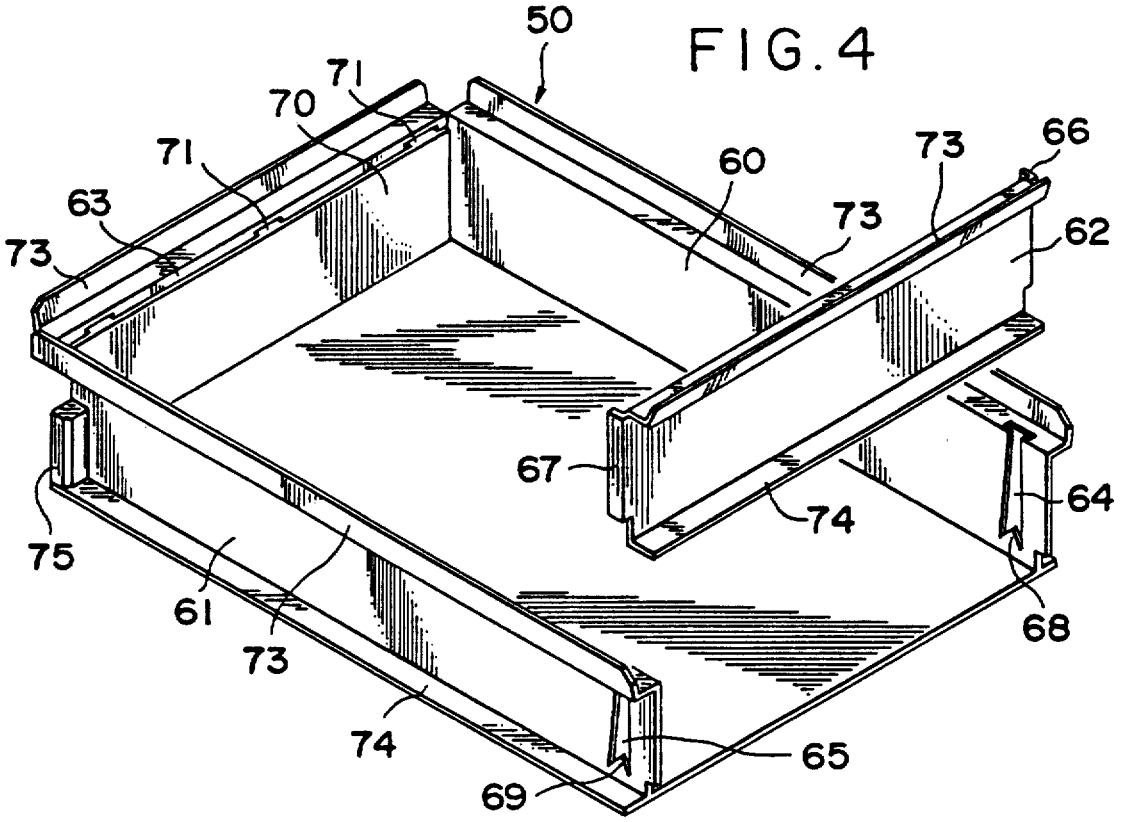
Figure 5:
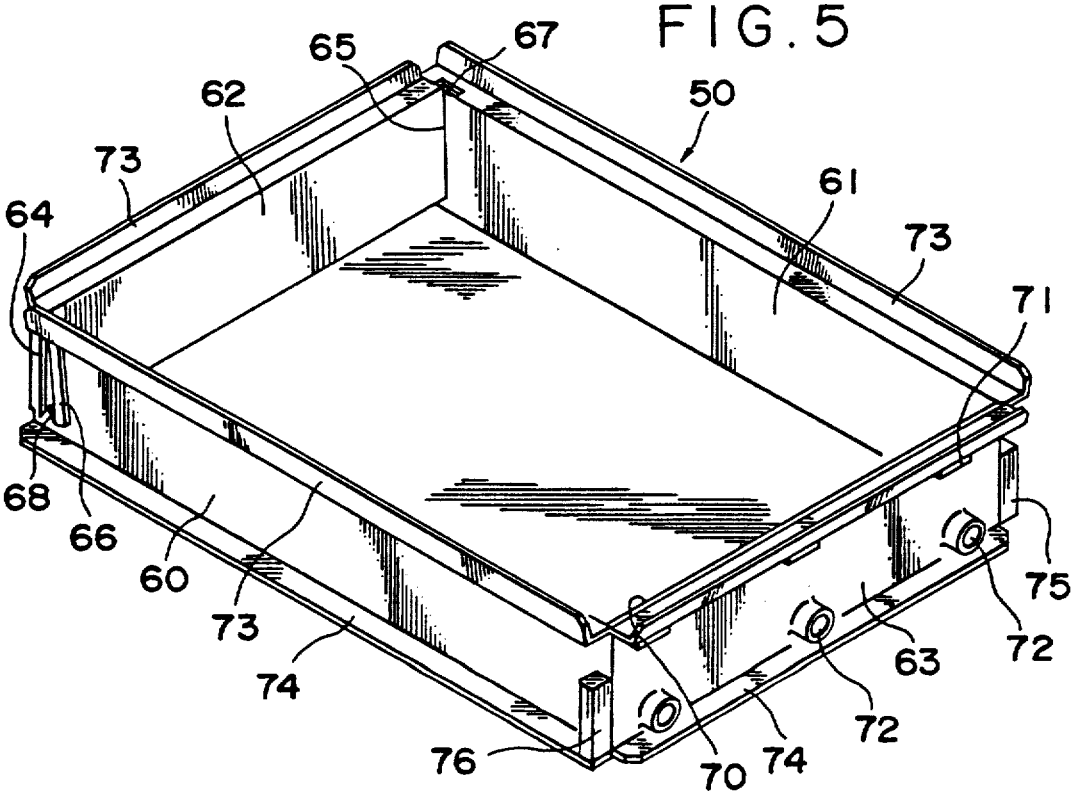
FIG. 5 is a perspective view showing the same case as that shown by FIG. 4 but as viewed from its rear side.

Referring to FIGS. 4 and 5 which are perspective views of the individual case 50 as viewed in different directions, respectively, reference numerals 60, 61 designate left and right side plates, respectively, 62 a shutter, and 63 a rear side plate.

Figure 6A:
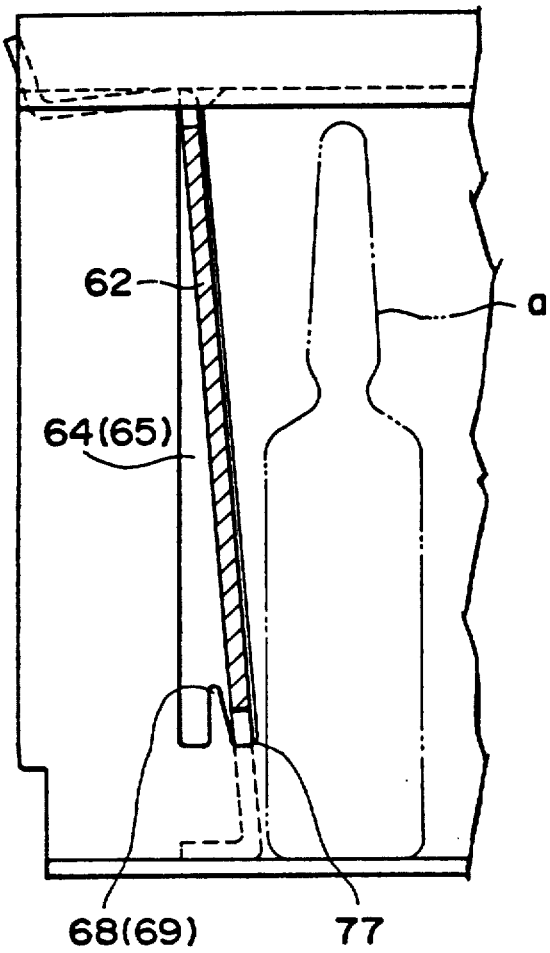
FIGS. 6A and 6B show a portion of the case adjacent the vertical slot partially in section and in an enlarged scale.

A pair of vertical slots 64, 65 are formed through the left and right side plates 60, 61 adjacent their front ends so that bent portions 66, 67 respectively formed on left and right ends of the shutter 62 may be received by said vertical slots 64, 65. These vertical slots 64, 65 are shaped substantially in triangles being downwardly divergent and formed on bases of the respective triangles with pointed protrusions 68, 69 so that the bent portions 66, 67 of the shutter 62 being engaged with the vertical slots 64, 65 may be selectively positioned before or behind these pointed protrusions 68, 69. FIG. 6A shows a state in which the shutter 62 is slightly inclined forward with their bent portions being positioned in notches 77 behind the pointed protrusions 68, 69.

Figure 6B:
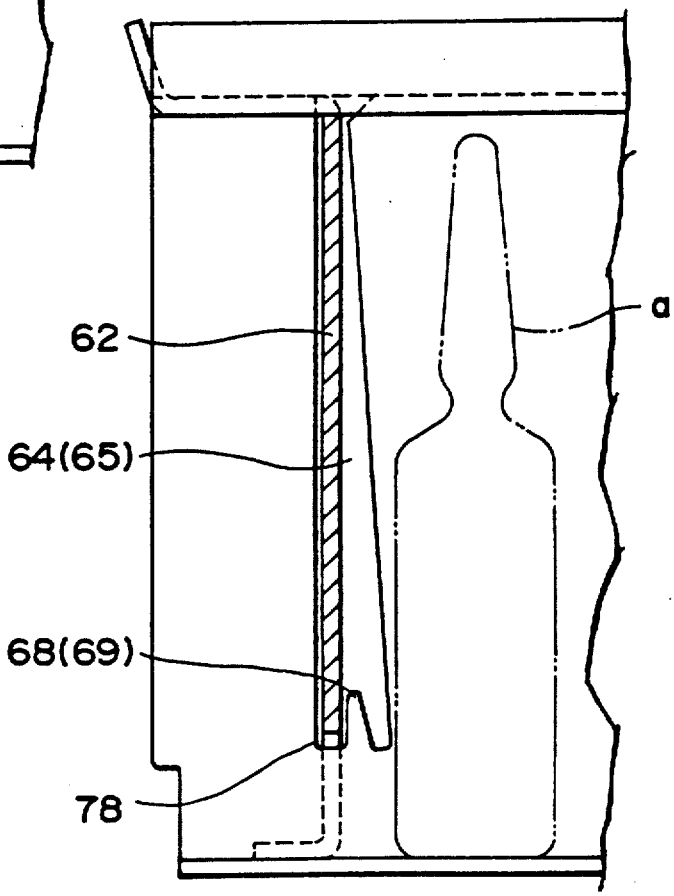
Figure 7:
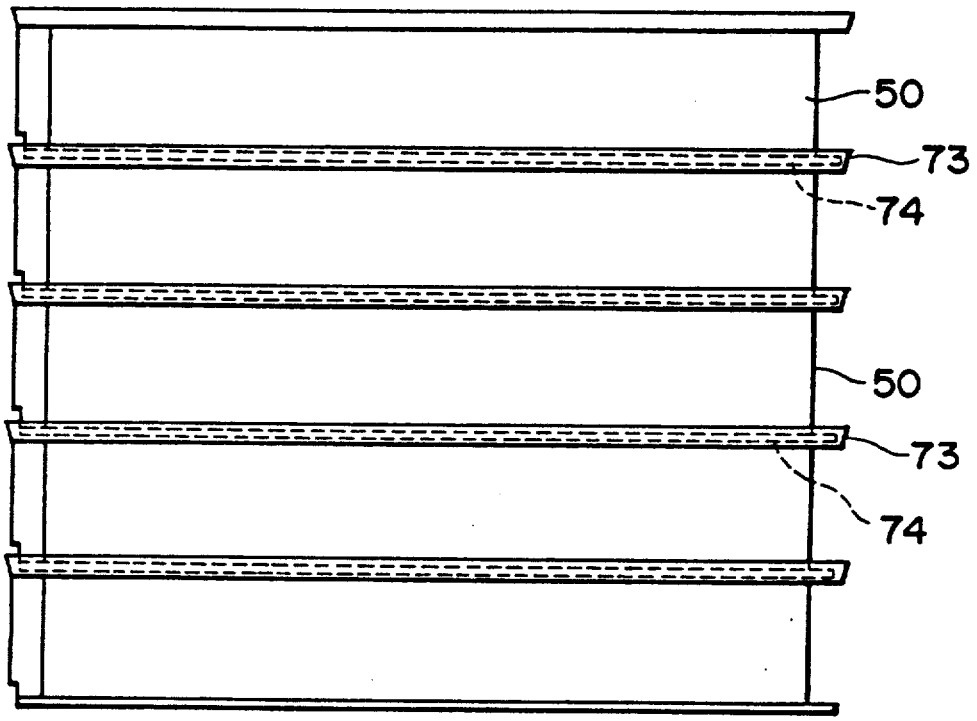
FIG. 7 is a front view showing a plurality of cases as being stacked one on another.

FIG. 6B shows a state in which the shutter 62 is vertically oriented with their bent portions being positioned in notches 78 before the pointed protrusions 68, 69.

In the case 50 filled with the ampules (a) before introduced into the apparatus proper 11, the shutter 62 is inclined as shown by FIG. 6A and the ampules (a) in the foremost row is in contact with the lower end of the shutter 62 but spaced from the upper end thereof.

The rear side plate 63 is provided on its inside with a pusher plate 70 which is swingable around hooks 71 so that, as will be described later, pushers project through respective tubular windows 72 extending outward from the rear side plate 63, causing the pusher plate 70 to be swung forward. Reference numerals 74 designate lower flanges adapted to be engaged with respective upper flanges 73 of the immediately upper case 50 so as to maintain the stacked cases 50 in alignment with one another when a plurality of the cases 50 are stacked. Reference numerals 75, 76 designate positioning blocks adapted to be utilized in the ampule supply station 200, as will be described later.

Now the supply apparatus 10 will be described. The case feeding station 100 is adapted to receive the cases 50 stacked, for example, in ten stages and introduction of these cases 50 is performed, for example, by using a flatcar 101.

The apparatus proper 11 contains therein a feeding conveyor 102 adapted to transport the cases 50 one by one from the stack bottom to a position in front of the apparatus.

Figure 8:
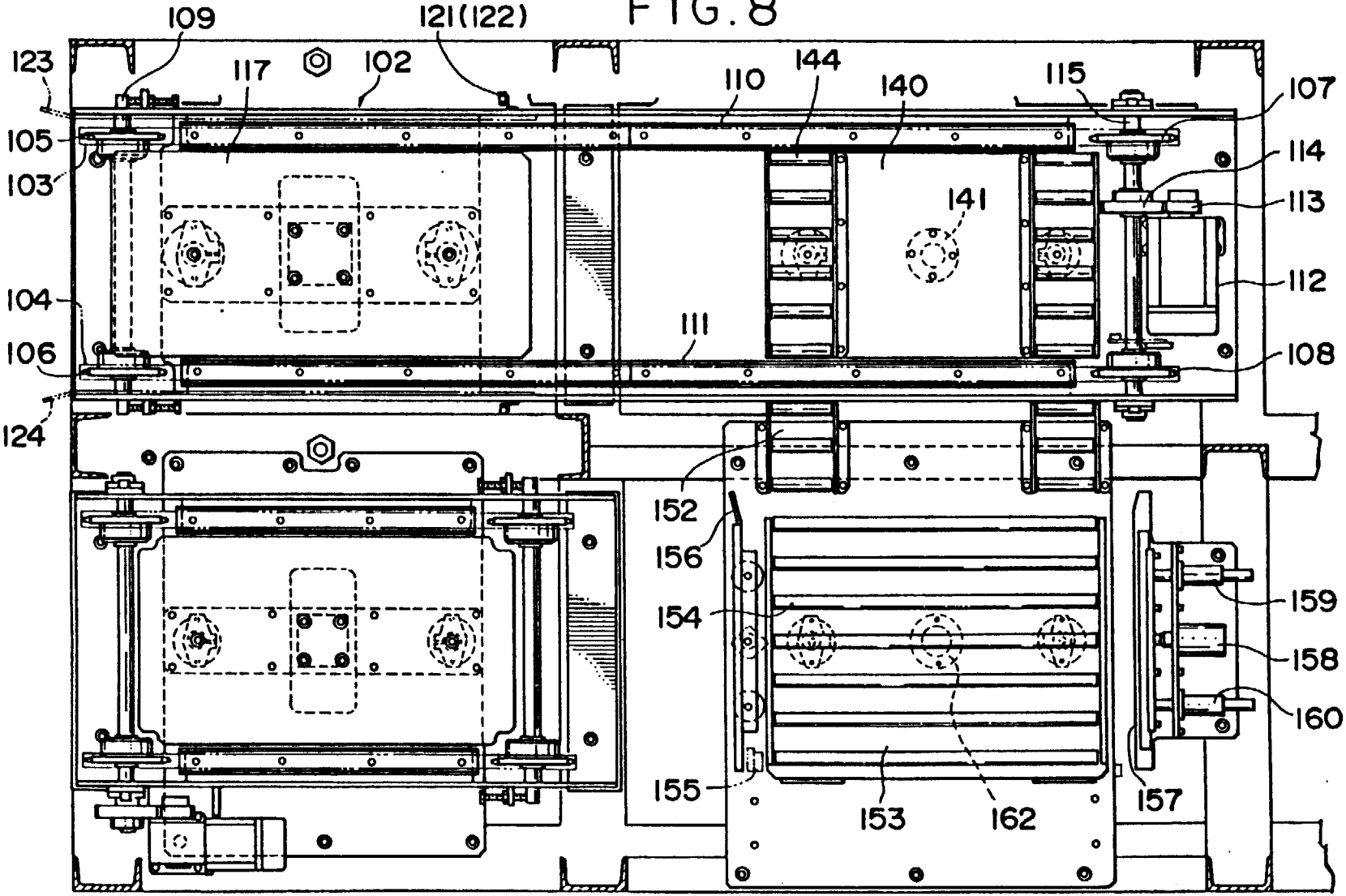
FIG. 8 is a plan view showing, partially in section, interior of the case feeding station, the case discharging station and the ampule supply apparatus.
Figure 9:
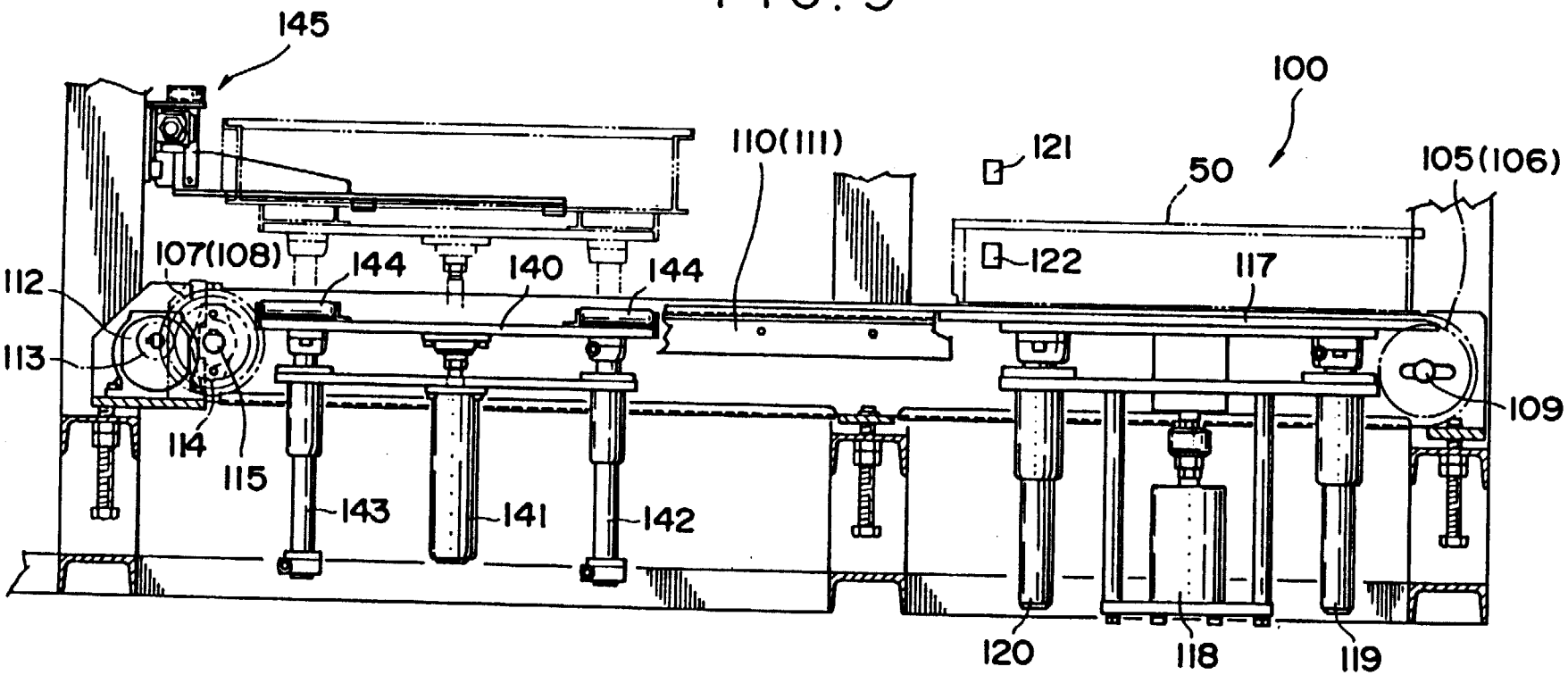
FIG. 9 is a left side view showing, partially in section, the feeding conveyor.
Figure 10:
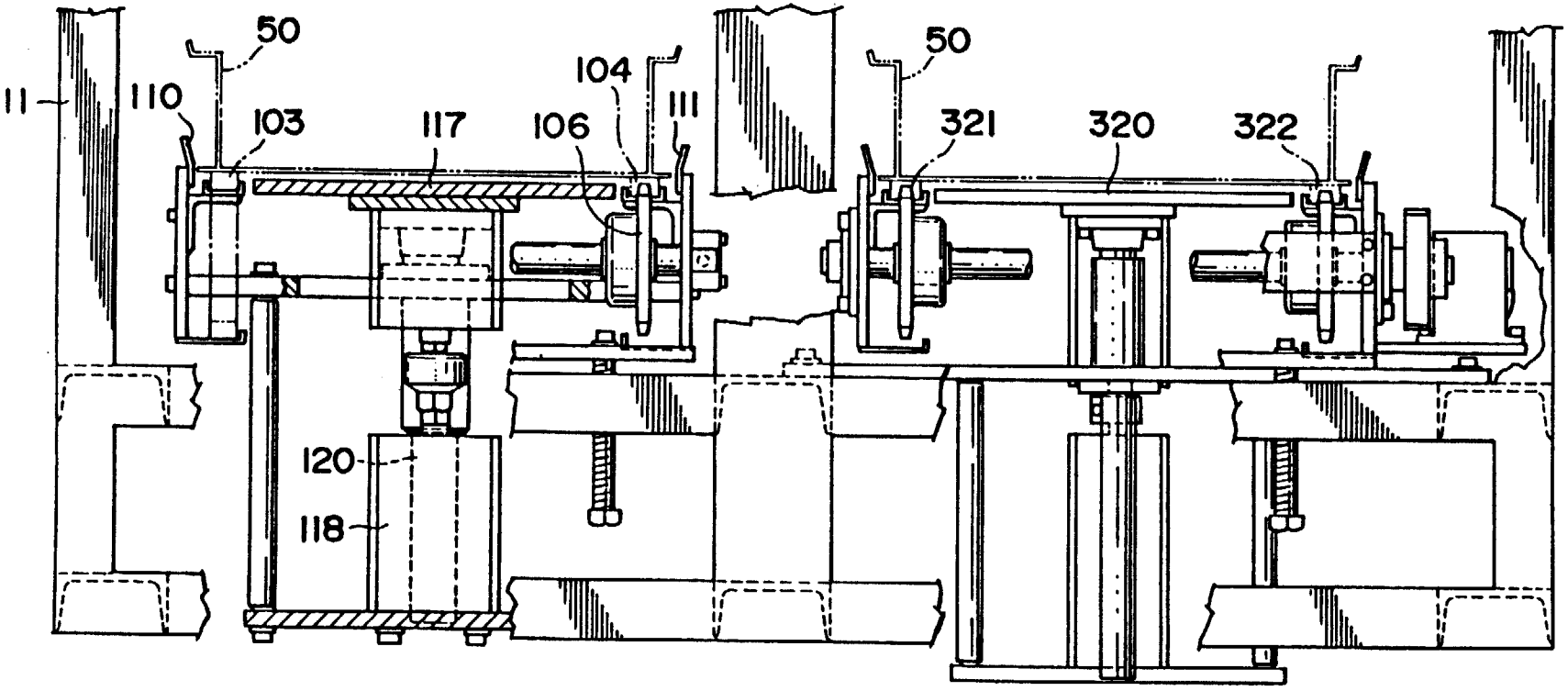
FIG. 10 is a front view showing the case feeding and discharging station.

FIGS. 8 and 9 show such feeding conveyor 102 provided within the apparatus proper 11. Reference numerals 103, 104 designate a pair of endless belts extending side-by-side which are respectively in operative association with follower sprockets 105, 106 and driver sprockets 107, 108. Reference numeral 109 designates a follower shaft rotatably mounted within the apparatus and reference numerals 110, 111 designate support rails for the endless belts 103, 104.

There is provided in front of the apparatus an electromotor 112 of which the rotation is transmitted by gears 113, 114 to a drive shaft 115, causing the endless belts 103, 104 to be moved round.

Reference numeral 117 designates a lifter provided between the pair of endless belts 103, 104. Reference numeral 118 designates a cylinder for vertically moving said lifter 117 and reference numerals 119, 120 designate guide bars.

It will be considered how the individual cases 50 are transported after they have been introduced into the case feeding station as a stack of the cases. Upon introduction of the stacked cases 50 into the case feeding station 100, a pair of sensors 121, 122 vertically spaced from each other detect it and control the feeding conveyor 102 so as to stop the stacked cases 50 just above the lifter 117. Provision of these two sensors vertically spaced from each other is effective to avoid a possibility that an erroneous detection might occur when the stack introduced involves a misalignment.

Reference numerals 123, 124 designate guide plates for smooth introduction of the cases 50 into the supply apparatus 10.

Figure 11:
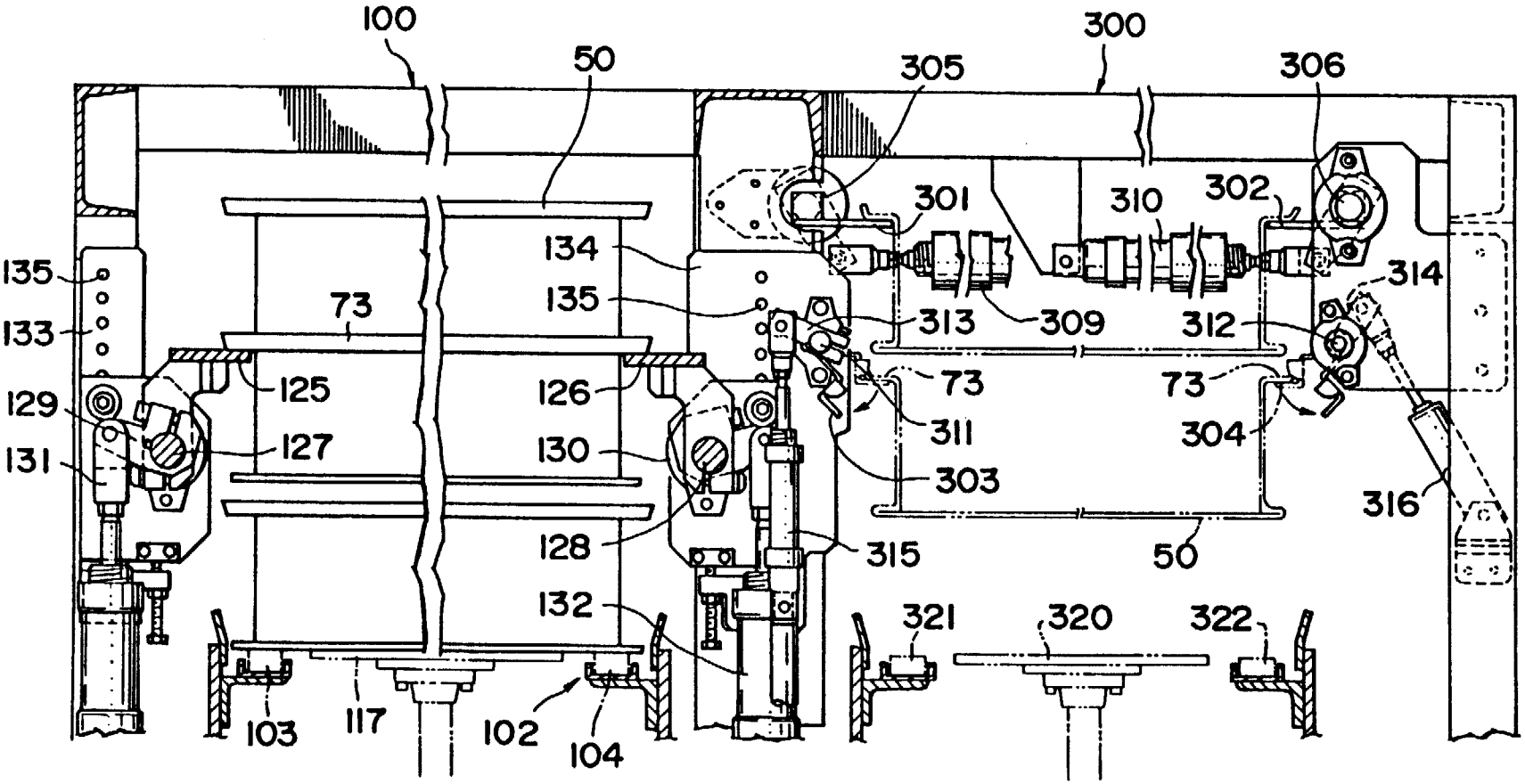
FIG. 11 schematically shows how respective levers of the case feeding and discharging stations shown by FIG. 10 operate.

As seen in FIG. 11, levers 125, 126 are swung, from opposite sides of the cases 50 which have been stopped at the case feeding station 100 as has been mentioned above, into engagement with the upper flange of any one of the cases 50 so that the stacked cases 50 may be supported by these levers 125, 126 above the feeding conveyor 102.

Operation of the levers 125, 126 will be described in reference with FIGS. 12 and 13. These levers 125, 126 are mounted on rotatable shafts 127, 128, respectively, and crank arms 129, 130 fixedly mounted on these rotatable shafts 127, 128 substantially at their middle points are vertically moved by respective cylinders 131, 132 so that the levers 125, 126 be swung into engagement with the case 50.

Levels of these levers 125, 126 can be adjusted by selecting an appropriate pair from a plurality of clamping holes 135 formed in plates 133, 134.

Figure 14:
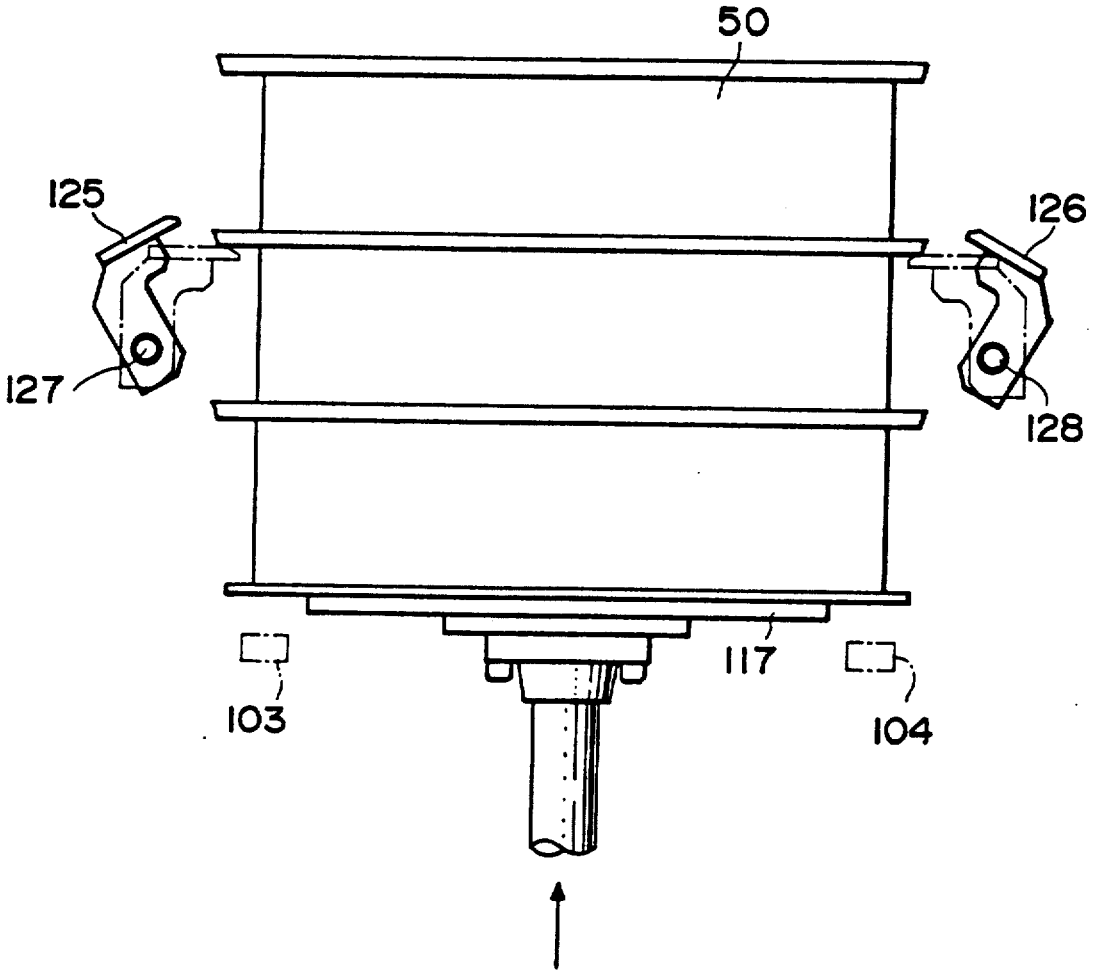
FIG. 14 illustrates the stacked cases being lifted by the lifter in the case feeding station.

After the stacked cases 50 introduced in the case feeding station 100 have been lifted up by the lifter 117 as shown by FIG. 14, the levers 125, 126 are swung inwardly and then the lifter 117 is lowered again, resulting in that, as seen in FIG. 11, all the cases 50 except the bottom case 50 are supported by the levers 125, 126 and only said bottom case is transported onto the endless belts 103, 104.

By taking the cases out successively one by one from the bottom of the stack, the bottom case 50 is always positioned by the levers 125, 126 on the feeding conveyor 102 in parallel with the direction of conveyance even when the stacked cases 50 involve a misalignment cumulatively increasing from the bottom to the top. More specifically, the levers 125, 126 are provided so as to cooperate with opposite longitudinal sides of the case 50, respectively, as shown in FIG. 12, so that these levers 125, 126 function as guides for the case 50.

Accordingly, the bottom case 50 has already been positioned by the levers 125, 126 in parallel with the conveyance direction of the feeding conveyor and, merely by taking the bottom case 50 out from the stack, it is assured that this case 50 can be transported onto the endless belts 103, 104 in parallel with the direction of conveyance.

Upon actuation of the feeding conveyor 102 by the electromotor 112, the stacked cases 50 having been introduced into the case feeding station 100 in such stacked condition are transported by the endless belts 103, 104 successively one by one to a predetermined position in front of the apparatus, where the case 50 strikes against a stopper and thereupon the electromotor 112 is deenergized.

The case 50 is thus transported to the foremost position of the feeding conveyor 102. There is provided a lifter 140 at this position below the case 50 between the endless belts 103, 104. Referring to FIG. 9, reference numeral 141 designates a cylinder serving for vertically moving this lifter 140 and reference numerals 142, 143 designate guide bars. The lifter 140 carries on its top surface a plurality of rollers 144 adapted to facilitate horizontal movement of the case 50.

There is provided a longitudinally slidable arm 145 slightly above the case 50 which has been stopped at the foremost position of the feeding conveyor 102. As will be apparent from FIG. 15, the longitudinally slidable arm 145 has a base end 146 mounted on a guide 147 so as to be movable along said guide 147, i.e., rightward or leftward as viewed in FIG. 15 under actuation of a rodless cylinder 148.

Reference numerals 149, 150 designate switches adapted to detect when said longitudinally slidable arm 145 reaches left and right ends positions, respectively.

Figure 15:
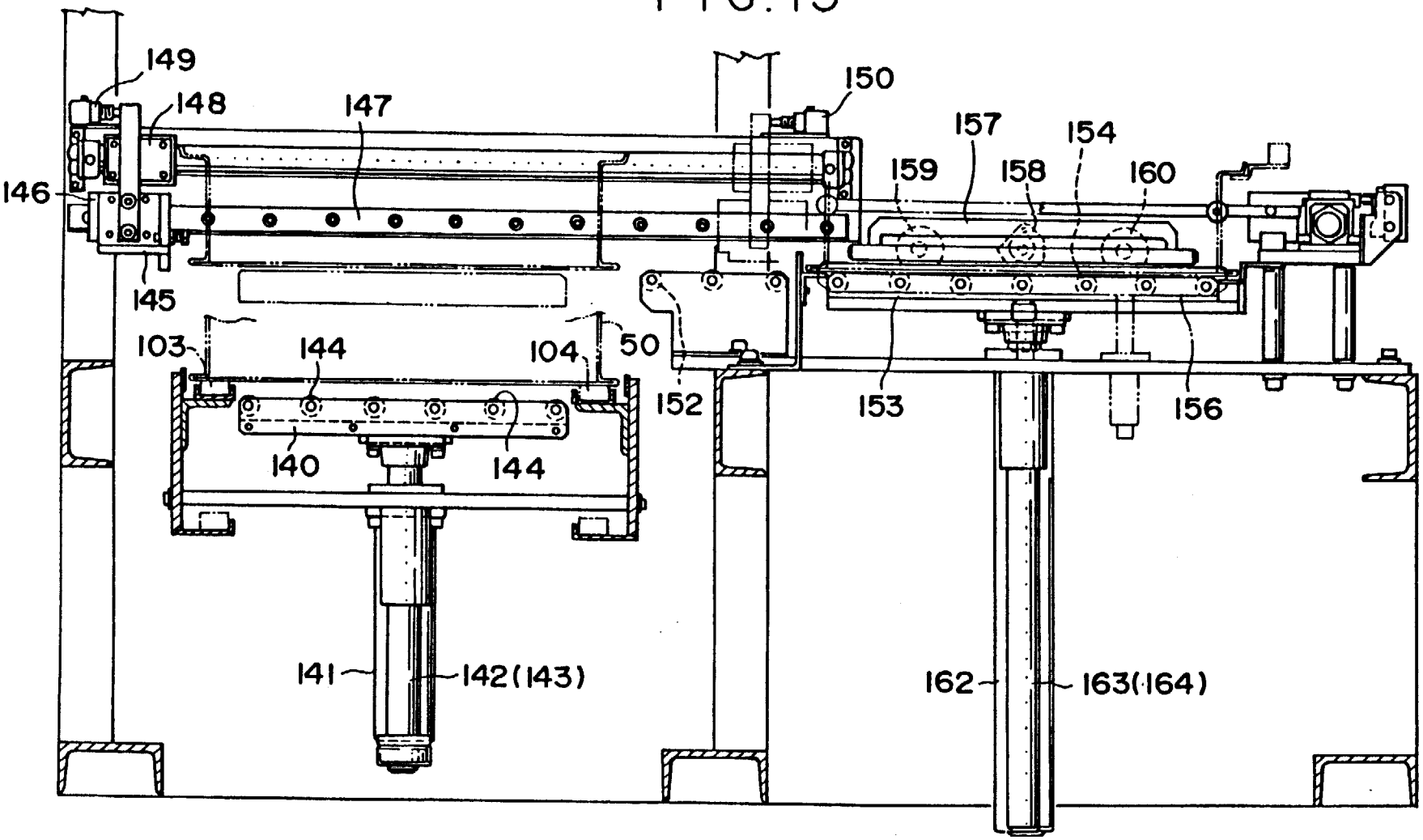
FIG. 15 is a front view showing the longitudinally slidable arm and the lifter provided below the ampules supply apparatus together with their vicinities.
Figure 16:
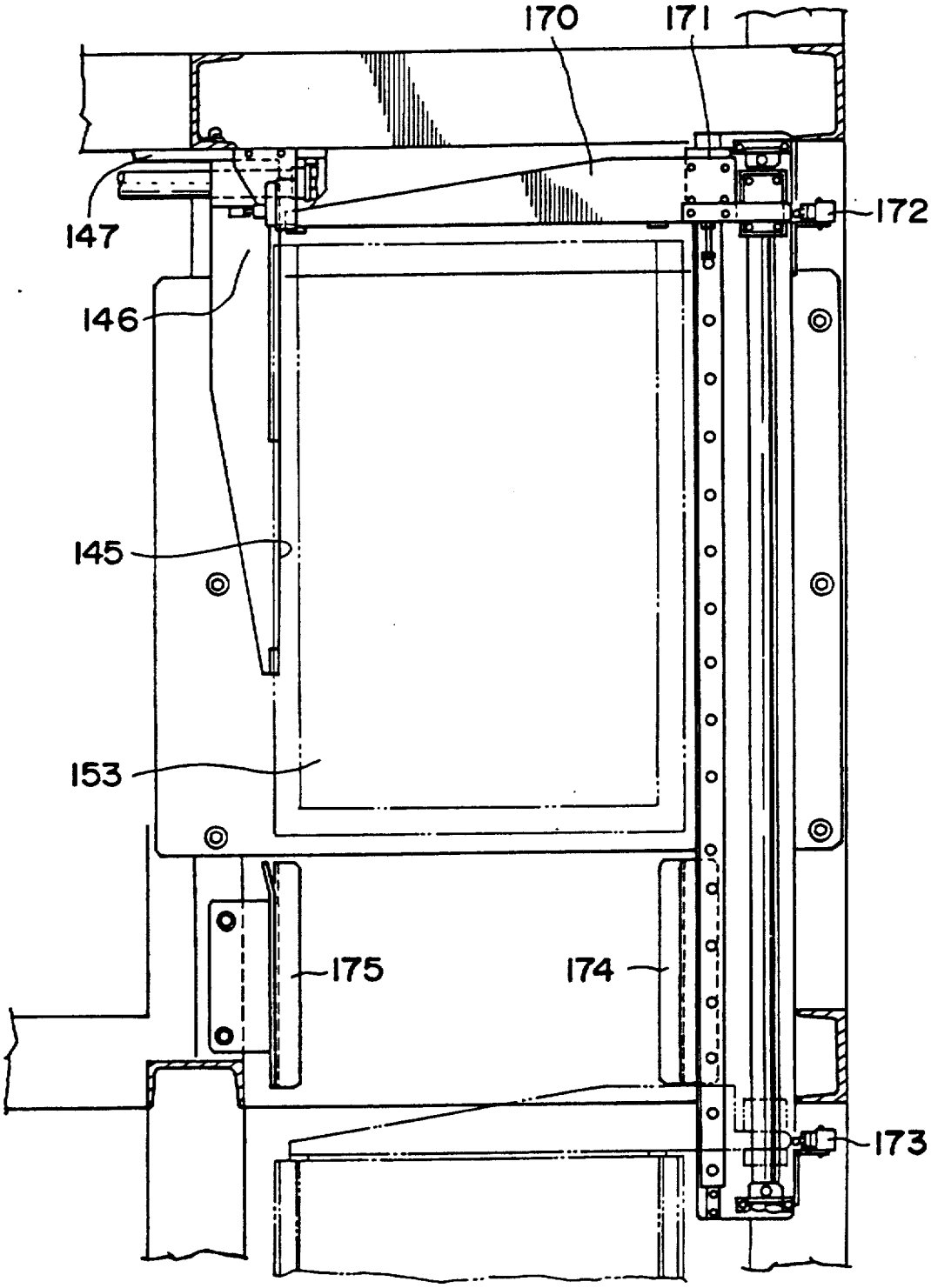
FIG. 16 is a plan view showing the longitudinally slidable arm and the transversely slidable arm.

The case 50 having been stopped at the foremost position of the feeding conveyor 102 is now lifted by the lifter 140 away from the belts 103, 104 and then laterally pushed by the longitudinally slidable arm 145 so as to be transferred via intermediate rollers 152 onto a lifter 153, as seen in FIGS. 15 and 16.

As will be apparent from FIGS. 8 and 15, the lifter 153 is provided on its top surface with rollers 154 to facilitate smooth introduction of the cases 50.

Referring to FIG. 8, reference numeral 155 designates a sensor to detect when the case 50 is introduced, 156 a guide to maintain the case 50 being introduced properly oriented and 157 a positioning pusher for properly positioning the case 50 on the lifter 153. Said positioning pusher is moved back and forth along guides 159, 160 in operative association with a cylinder 158.

Figure 17:
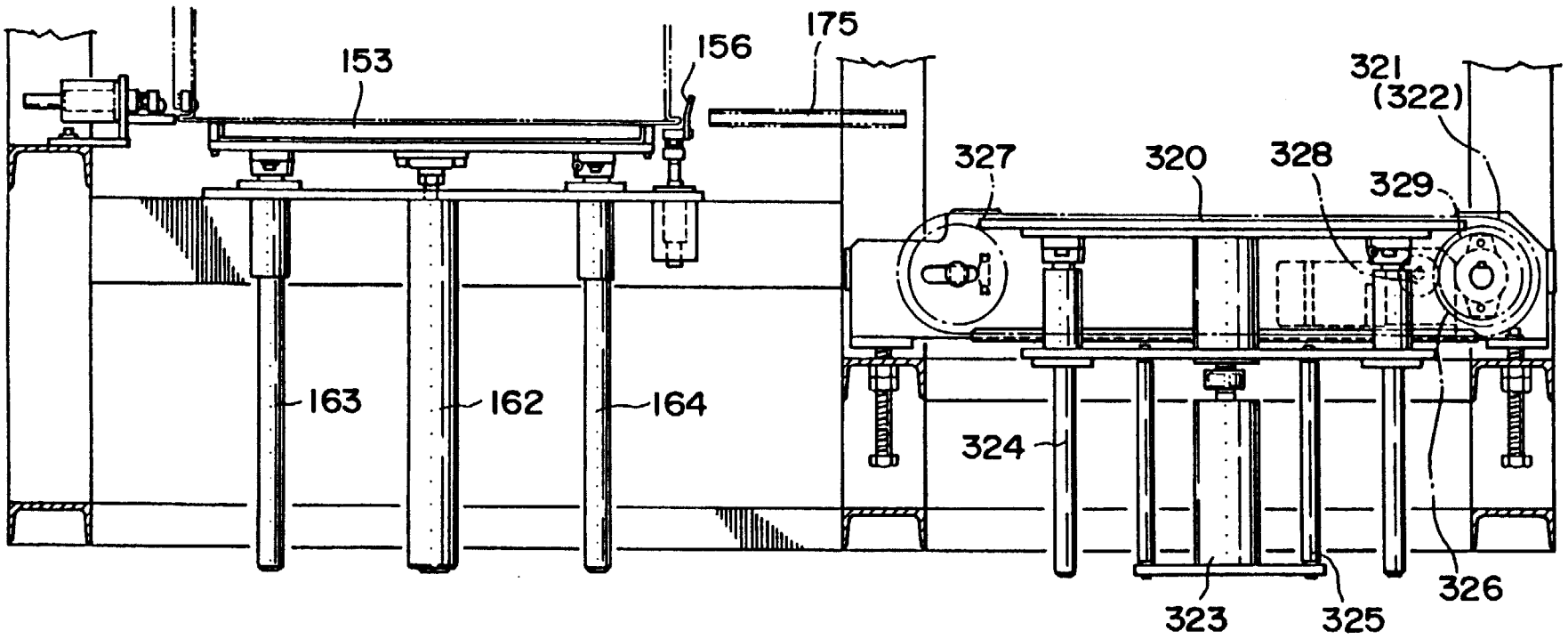
FIG. 17 is a left side view showing the lifter provided below the ampule supply apparatus and the lifter associated with the case discharging station together with their vicinities.

Referring to FIG. 17, the lifter 153 is provided on its underside with a cylinder 162 and guide rods 163, 164 for vertically moving the lifter 153.

In this way, the case 50 having been stopped at the foremost position of the feeding conveyor 102 is pushed by the longitudinally slidable arm 145 onto the lifter 153 and, after properly oriented by the pusher 157, the case 50 is transported by the lifter 153 up to the ampule supply station 200.

Taking out of the ampule (a) occurs in this ampule supply station 200 in a manner as will be described.

The ampule supply station 200 will be described in reference with FIGS. 18 through 21. Reference numeral 201 designates a movable block which is movable along a pair of rails 202, 203 extending on the top surface of the apparatus proper 11. Reference numeral 204 designates a rotatable threaded shaft adapted to be rotated by an electromotor 208 via timing pulleys 205, 206 and a timing belt 207.

The movable block 201 is provided on its underside with a bracket 210 through which said rotatable threaded shaft 204 extends so that said movable block 201 is moved along the rails 202, 203 as the electromotor 208 is actuated to rotate said rotatable threaded shaft 204.

Figure 18:
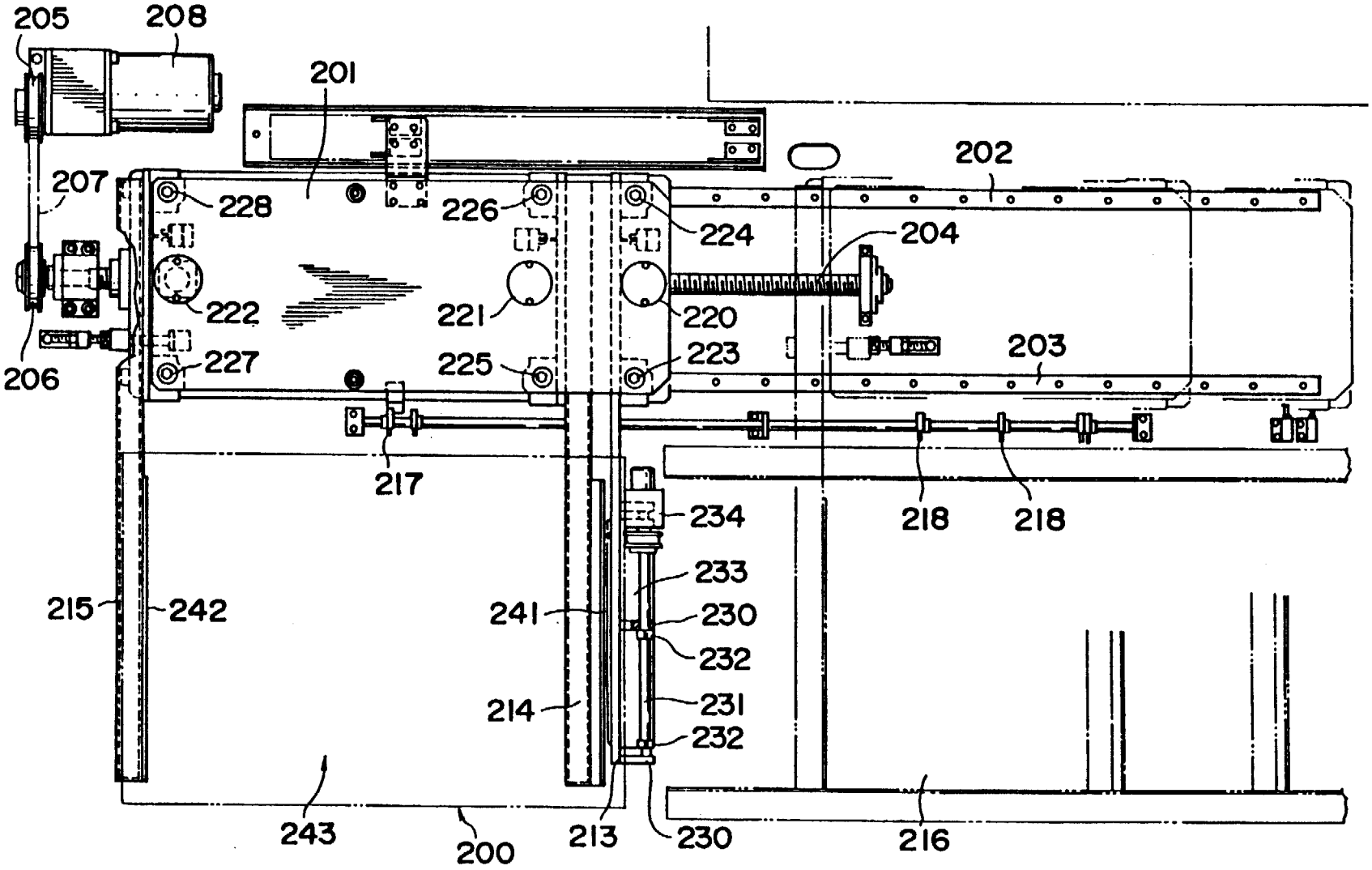
FIG. 18 is a plan view showing the ampule supply apparatus.
Figure 19:
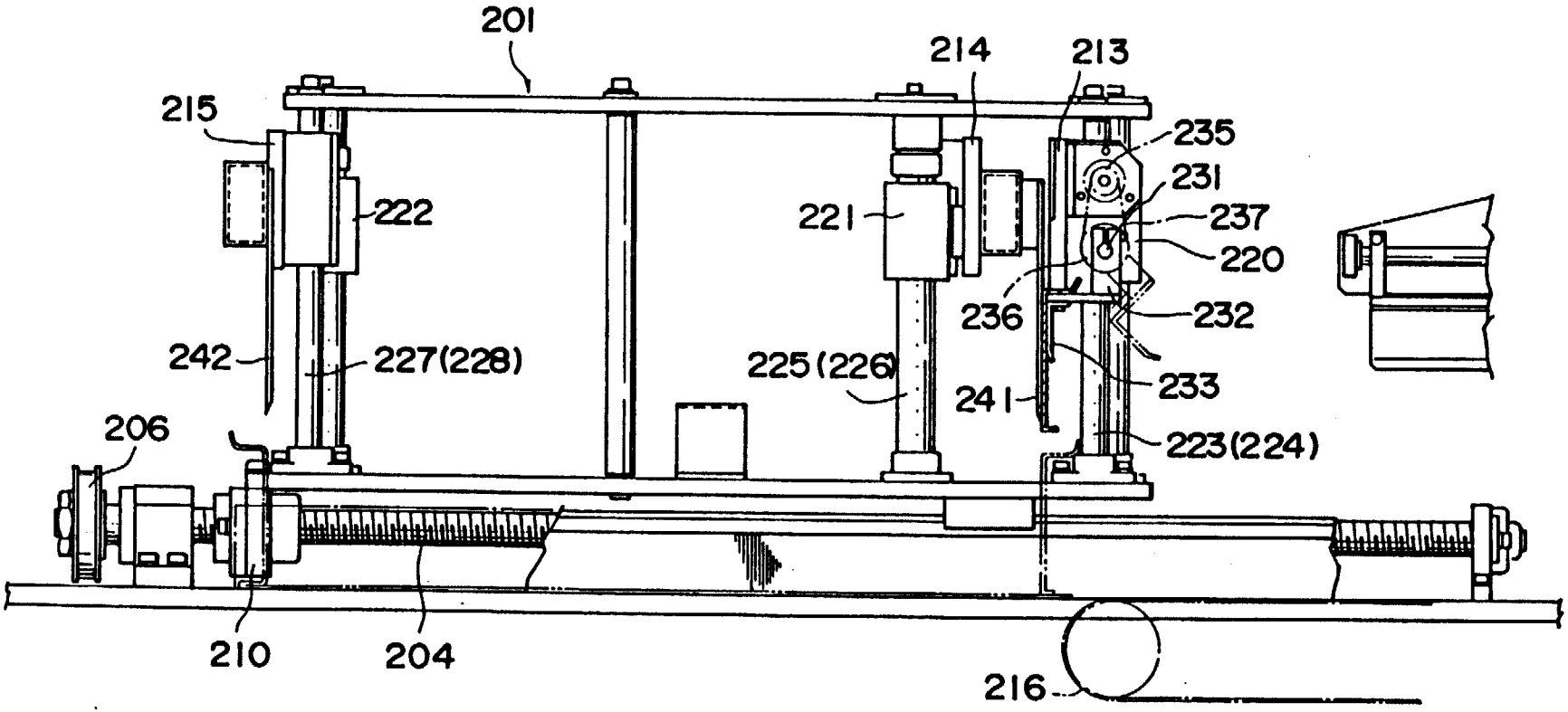
FIGS. 19, 20 and 21 are front, right side and left side views of the movalbe block, respectively.

As shown in FIG. 18, the movalbe block 201 carries first through third plates 213–215. Reference numeral 216 designates a conveyor used to feed the ampules (a) to other lines, for example, of packaging and sterilization. The respective plates 213, 214, 215 laterally move onto this conveyor 216 as the movable block 201 laterally moves. Reference numerals 217, 218 designate sensors to detect such movement of said plates.

The respective plates 213, 214, 215 are provided with rodless cylinders 220, 221, 222, respectively, used to move the associated plates 213, 214, 215 vertically along respective pairs of guide supports 223, 224; 225, 226; and 227, 228.

Figure 20:
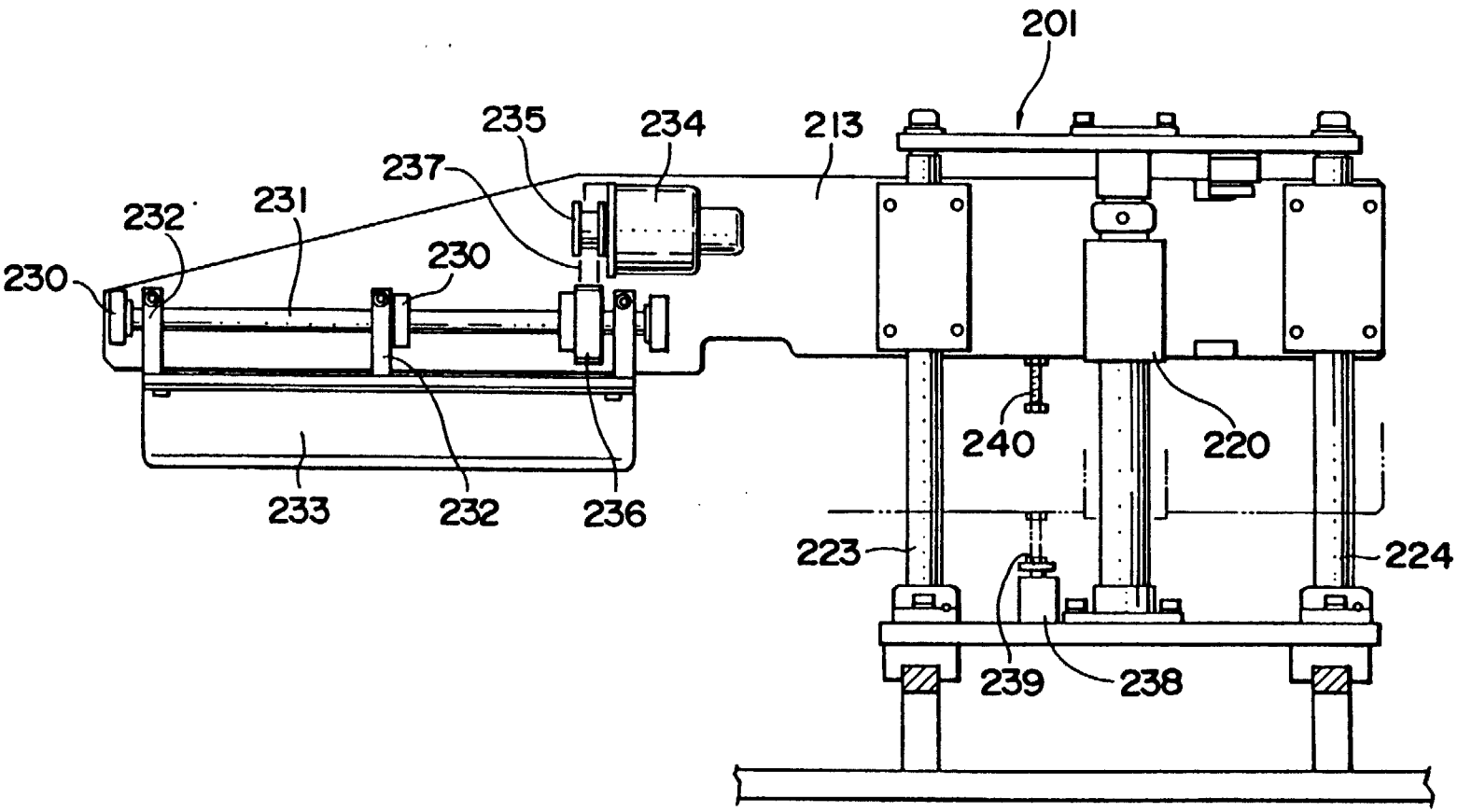
Figure 21:
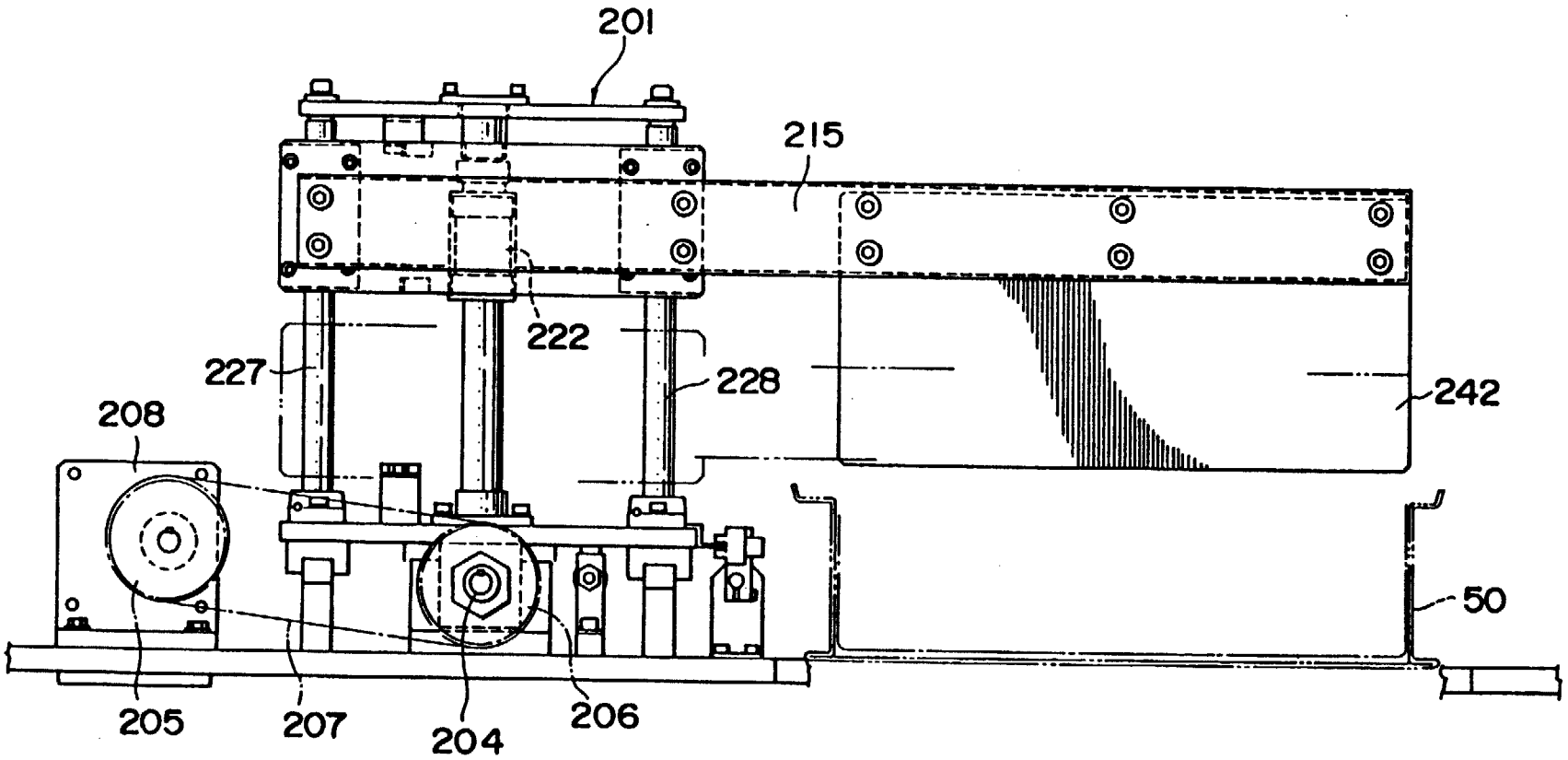

Referring to FIG. 20, the first plate 213 carries a rotatable shaft 231 by a bracket 230 and a chuck 233 is secured to said rotatable shaft 231 by means of a crank 232. The first plate 213 is provided on its front side with an electromotor 234 which rotatably drives the rotatable shaft 231 by timing pulleys 235, 236 and a timing belt 237, thereby causing the crank 232 to be rotated and the chuck 233 to be swung so that the tip of said chuck 233 and the lower end of the first plate 213 move in close to and away from each other (See FIG. 19).

As will be apparent also from FIG. 20, the first plate 213 is adapted to be forced upward also by a cylinder 238 fixed to a lower portion of the movable block 201. Specifically, an upper end of a piston 239 associated with the cylinder 238 strikes against a bolt 240 threaded into the lower edge of the first plate 213 and is depressed thereby as the first plate 213 is lowered by actuation of the rodless cylinder 220 toward its lowermost level. Then, actuation of the cylinder 238 from such depressed position causes the first plate 213 to be forced upward again by the amount corresponding to that by which the piston 239 has been depressed. It should be understood that the amount by which the first plate 213 is forced upward by the piston 239 can be adjusted by threading the bolt 240 in or out to change an amount of its projection.

The second plate 214 is provided on its front side with a front ejector plate 241 which is vertically moved by actuation of the rodless cylinder 221.

Similarly, the third plate 215 is provided on its rear side with a rear ejector plate 242 which is vertically moved by actuation of the rodless cylinder 222.

In the ampule supply station 200 as has been mentioned just above, a free space 243 is available in front of the conveyor 216 and the case 50 is lifted by the lifter 153 through this free space 243 to the top surface of the apparatus proper 11.

Figure 22:
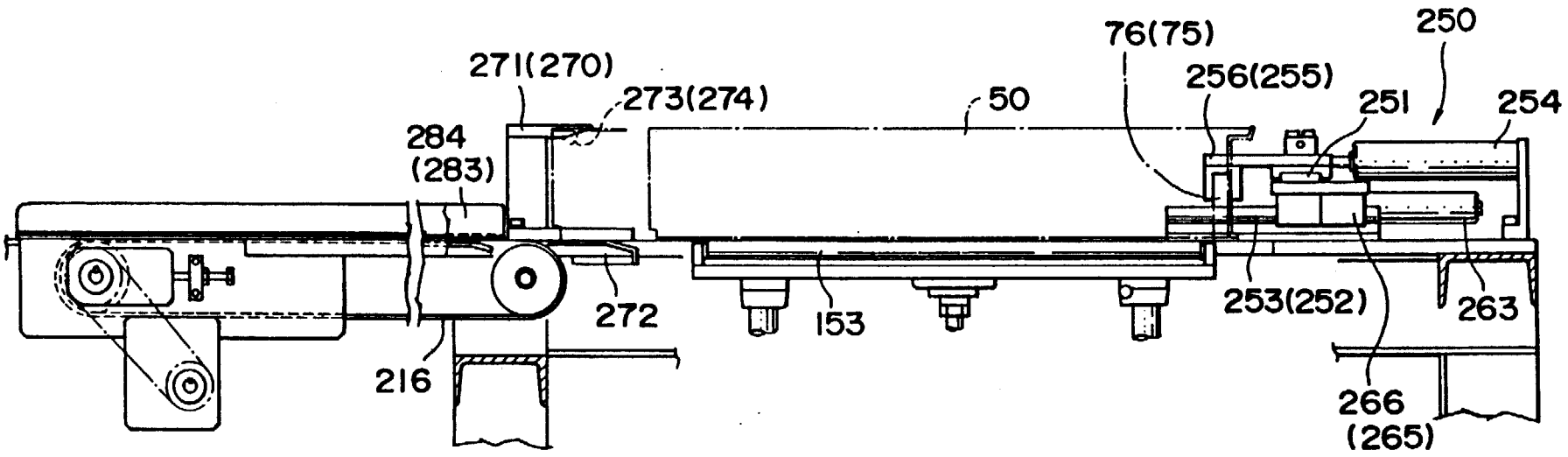
FIG. 22 is a side view showing an upper portion of the ampule supply apparatus and the conveyor associated therewith.
Figure 23:
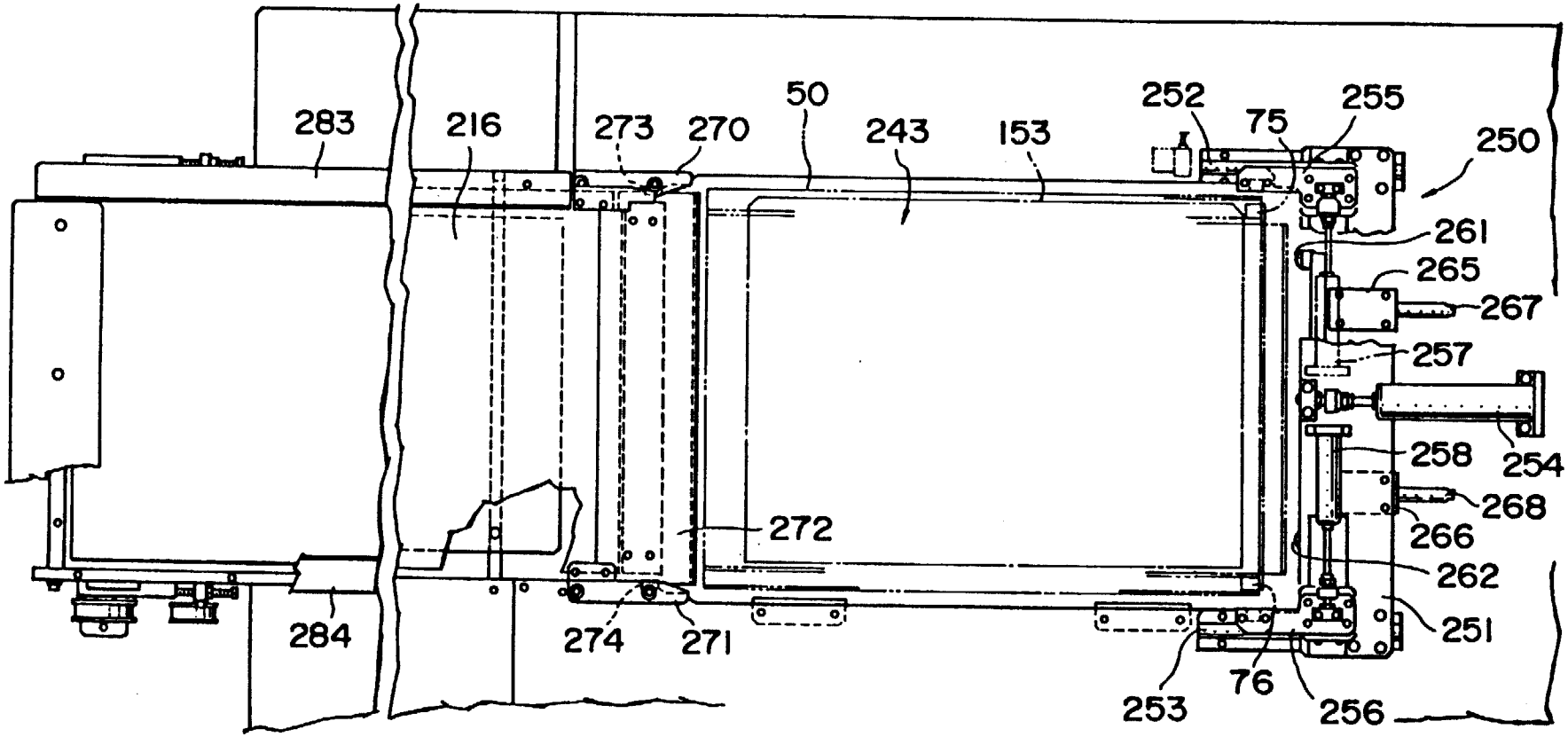
FIG. 23 is a plan view corresponding to FIG. 22.

FIGS. 22 and 23 show the ampule supply station 200 in which the case 50 has been lifted by the lifter 153.

There is provided a thrusting device 250 on a side remote from the side toward which the case is transported. Reference numeral 251 designates a thrusting device proper adapted to be moved by a cylinder 254 along a pair of rails 252, 253 extending on both sides of said thrusting device proper 251. Reference numerals 255, 256 designate clamps carried on both sides of the thrusting device proper 251 so that actuation of cylinders 257, 258 stationarily mounted on the top of the thrusting device proper 251 causes these clamps to grasp the positioning blocks 75, 76 formed on the rear side of the case 50.

Figure 24:
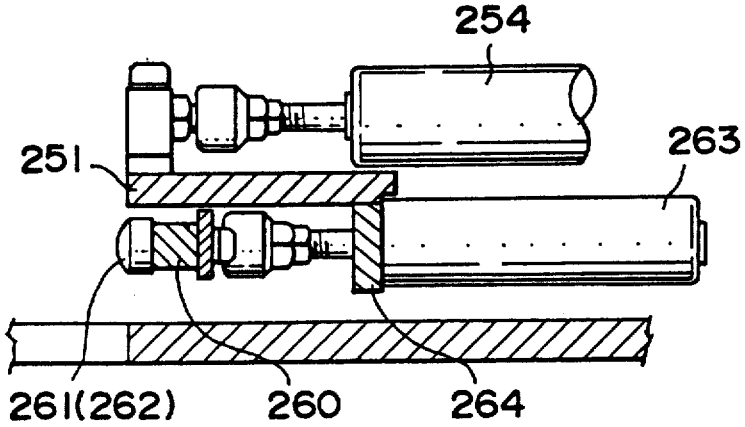
FIG. 24 is a side view showing the thrusting device and the pusher cylinder together with their vicinities.
Figure 25:
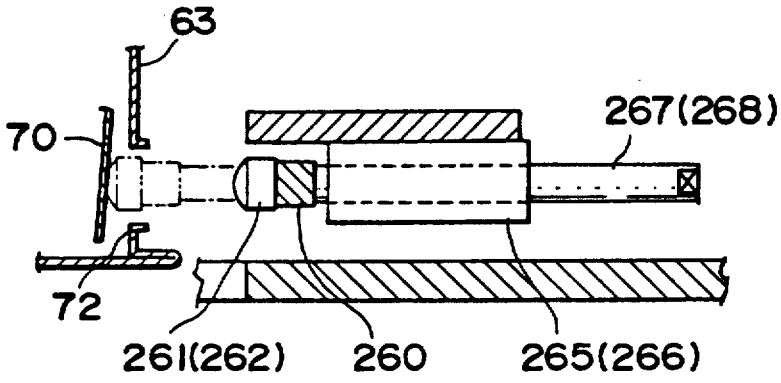
FIG. 25 illustrates how the pusher and the protrusion of the pusher operate.
Figure 26:
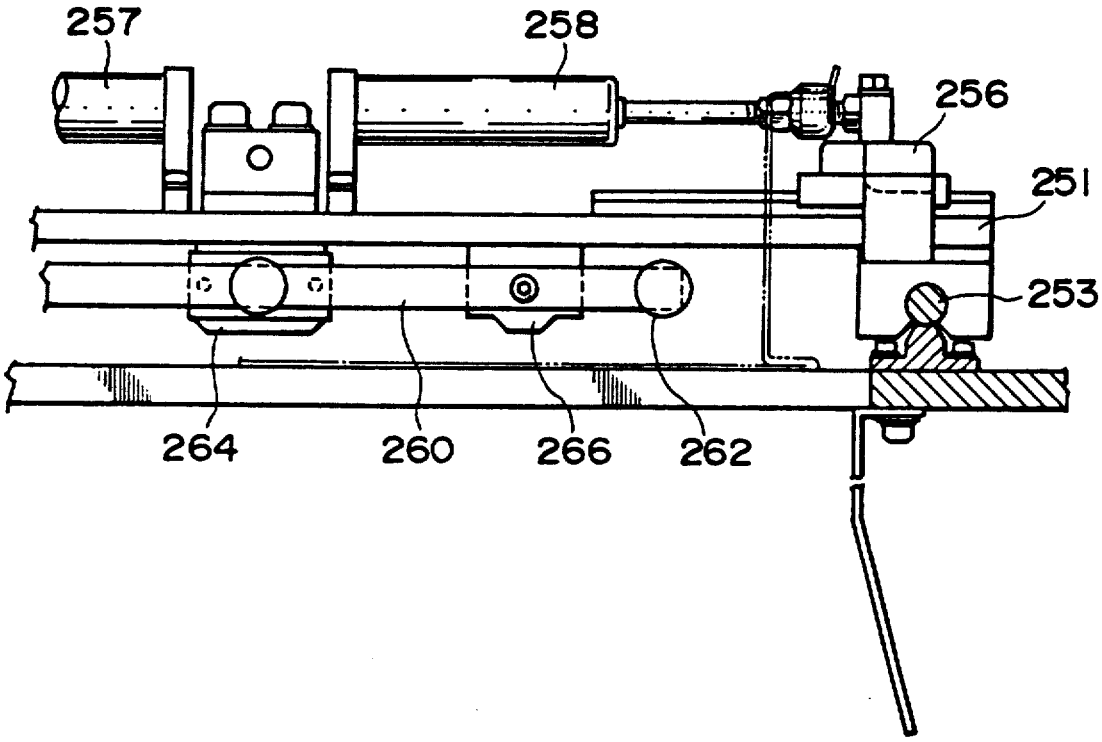
FIG. 26 is a front view corresponding to FIG. 24.

Referring to FIG. 24, the thrusting device proper 251 is provided on its underside with pushers 260 which are, in turn, provided on their front end surfaces with protrusions 261, 262. Reference numeral 263 designates pusher cylinders secured to a bracket 264 centrally provided on the underside of the thrusting device proper 251. The bracket 264 is provided on both sides thereof with tunnels 265, 266 through which a pair of rods 267, 268 connected to rear ends of the respective pushers 260 extend, respectively.

With the clamps 255, 256 of the thrusting device 250 grasping the respective positioning blocks 75, 76 of the case 50, actuation of the pusher cylinders 263 causes the respective pushers 260 to be moved forward close to the rear side plate 63 and then through the respective windows 72 of said rear side plate 63 so that the protrusions 261, 262 on the front end surfaces of the respective pushers 260 cause the pusher plate 70 to be swung.

Now referring to FIGS. 22 and 23, there are provided in front of the case 50 a pair of case positioning guides 270, 271 transversely opposed to each other and, below them, an ampule feeding plate 272 is aligned with the conveyor 216 substantially without a gap left therebetween.

As the case 50 is thrust forward by actuation of the cylinder 254 associated with the thrusting device 250, leading edges of the side plates 60, 61 laterally defining the case 50 are guided by said case positioning guides 270, 271 and thereby the case 50 is transported by the conveyor 216 in proper posture to the foremost position of said conveyor where the leading end of the case 50 comes in close contact with said ampule feeding plate 272 so that the case 50, the ampule feeding plate 272 and the conveyor 216 be flush with one another.

It should be understood that the case positioning guides 270, 271 are provided with rollers 273, 274, respectively, assisting the shutter 62 of the case 50 as will be described to be smoothly opened and closed.

A manner in which the apparatus of the invention operates after the case 50 has been transported to the ampule supply station 200 will now considered after the case 50 has been lifted by the lifter 153 up to the ampule supply station 200, the thrusting device 250 grasps the rear portion of the case 50, by the clamps 255, 256 and thrusts the case 50 forward by the cylinder 254 through a passage defined between the case positioning guides 270, 271 to the foremost position of the conveyor 216. The case 50 is properly oriented by said guides 270, 271 as the case 50 is moved through said passage.

The first plate 213 being at the forefront of the movable block 201 is lowered until the lower end of this first plate 213 comes in contact with the flange 73 of the shutter 62 inserted into the case 50 and thereupon the electromotor 234 is actuated, causing the chuck 233 to grasp this flange 73 of the shutter 62. It should be understood that, as has been described earlier in connection with the construction of the case 50, the shutter 62 is still in engagement with the rear notches 77 with respect to the pointed protrusions 68, 69, i.e., the shutter 62 is held inclined forward at this time point.

Figure 27:
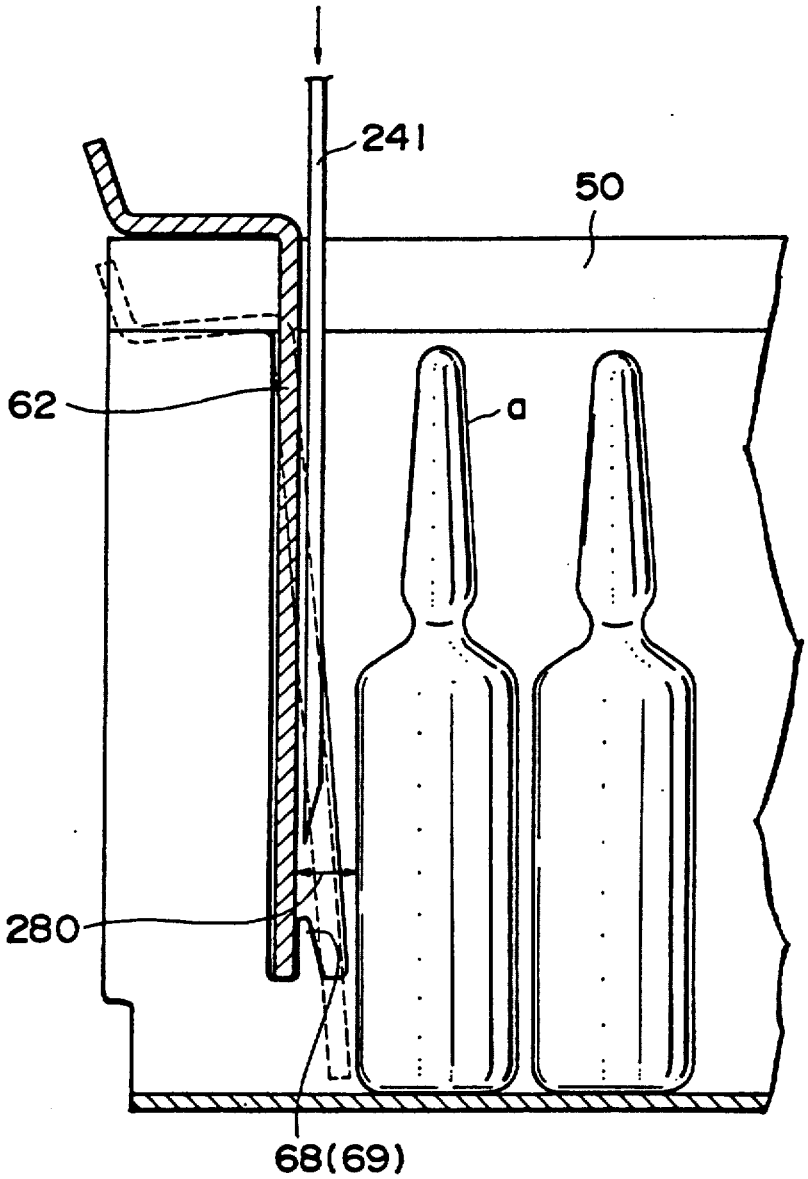
FIG. 27 illustrates the front of the case partially in section with the shutter of the case being vertical.
Figure 28:
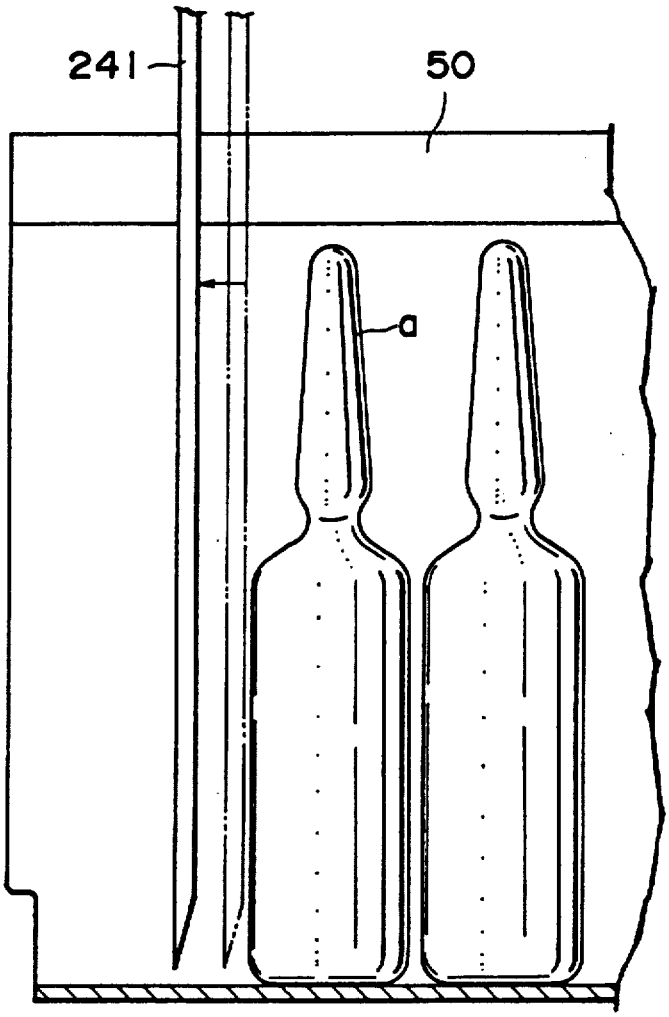
FIG. 28 illustrates the state in which the front ejector plate has been moved forward.
Figure 29:
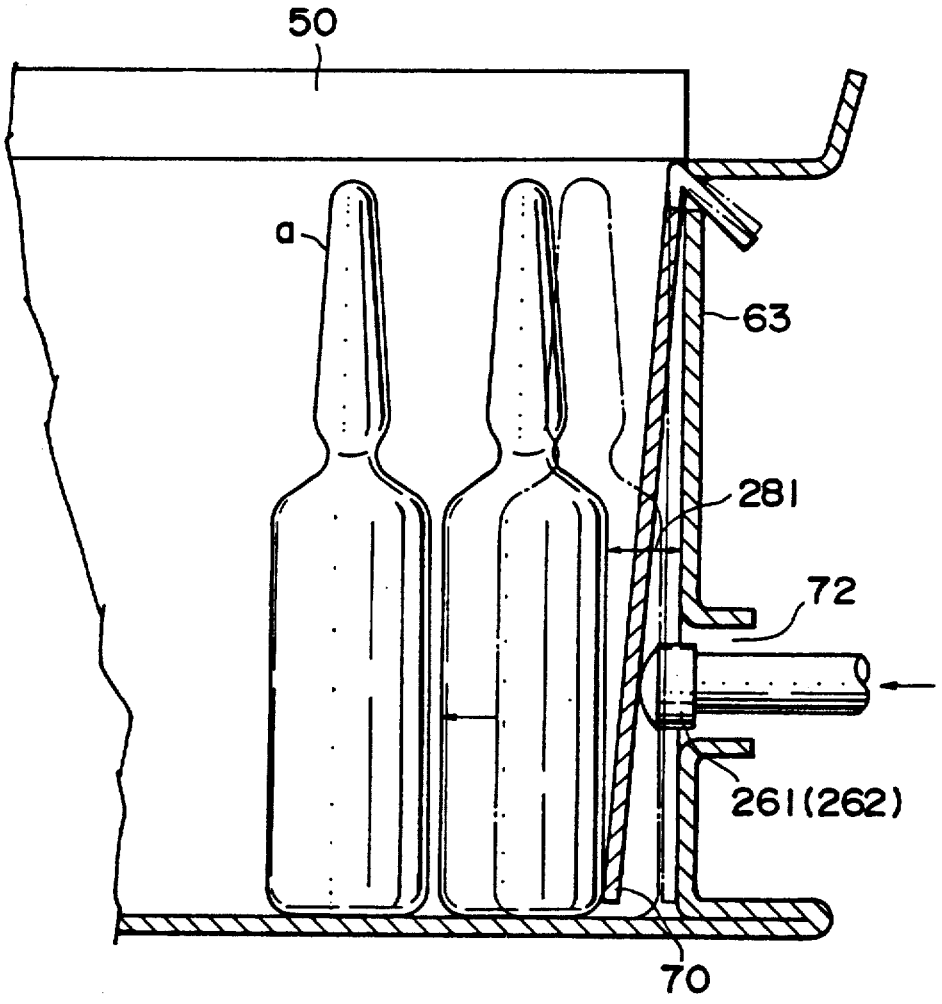
FIG. 29 illustrates the rear of the case partially in section, with the pressure plate having been swung forward by the protrusion of the pusher.

As the first plate 213 is slightly lifted by actuation of the cylinder 238, the shutter 62 is also slightly lifted out of engagement with said rear notches 77 and shifted to the vertical position in engagement with front notches 78 as seen in FIG. 27, to form a gap 280 between the ampules (a) in the foremost row and the shutter 62.

The rodless cylinder 221 may be actuated from the above-mentioned state to lower the second plate 241 so as to bring the front ejector plate 241 into said gap 280 and thereupon the first plate 213 may be lifted by actuation of the rodless cylinder 220 until the shutter 62 is completely pulled out upward from the case 50.

In this way, the front ejector plate 241 can be smoothly inserted into the gap 280 between the ampules (a) in the foremost row and the shutter 62, and the shutter 62 is always pulled out after insertion of the front ejector plate 241 so that the ampules (a) are kept against a possibility of being scattered out and falling down.

Then the movable block 201 is slightly shifted forward by actuating the electromotor 208 for a short period so as to move the front ejector plate 208 for a short period so as to move the front ejector plate 241 forward slightly away from the ampules (a) in the forefront row. Amount of such shift may correspond to or somewhat larger than a thickness of the rear ejector plate 242.

Now the pusher cylinders 263 are actuated behind the case 50 so as to move the protrusion 261, 262 mounted on the front ends of the respective pushers 260 through the respective windows 72 of the case rear side plate 63 into the case 50, causing the pusher plate 70 to rotate forward and thereby thrusting the rearmost row of the ampules (a) orderly stored in the case 50. As a result, all of the ampules (a) within the case 50 are moved forward by the distance between the front ejector plate 241 and the forefront row of the ampules (a) and a gap 281 corresponding to this distance is formed between the rearmost row of the ampules (a) and the rear side plate 63 of the case 50.

After the protrusions 261, 262 have been pulled out from the case 50 through the respective windows 72 of the rear side plate 63 by bringing the pusher cylinders 263 back to their initial positions, the rodless cylinder 222 of the movable block 201 is actuated to lower the third plate 215 and thereby to insert the rear ejector plate 242 smoothly into the gap 281.

Figure 30:
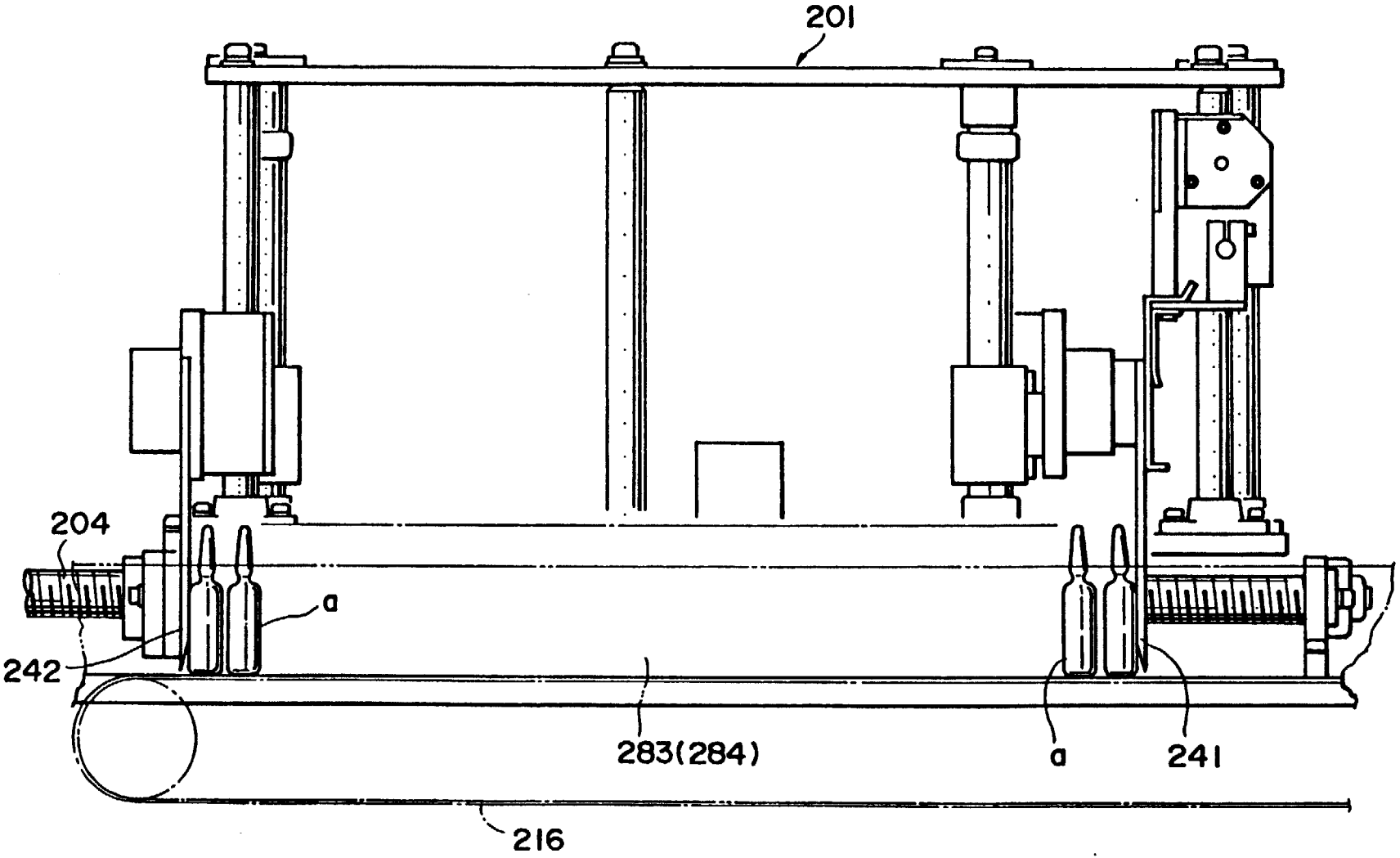
FIG. 30 is a front view showing the state in which the ampules have been moved by the movable block onto the conveyor.

Once all the ampules (a) within the case 50 have been held by the front ejector plate 241 and the rear ejector plate 242, the electromotor 208 is actuated again to shift the movable block 201 forward. In response to this shift of the movable block, the case 50 having the shutter 62 already removed discharges from it front side the ampules (a) held upright between the front and rear ejector plates 241, 242 which are then transferred onto the conveyor 216, as shown by FIG. 30. During this transfer, an ampule feeding plate 272 interposed between the case 50 and the conveyor 216 cooperates with guard rails 283, 284 extending along both sides of the conveyor 216 and along the laterally opposite side plates 60, 61 of the case 50 to restrict lateral displacement of the ampules (a) and thereby to assure smooth transfer thereof.

Figure 31:
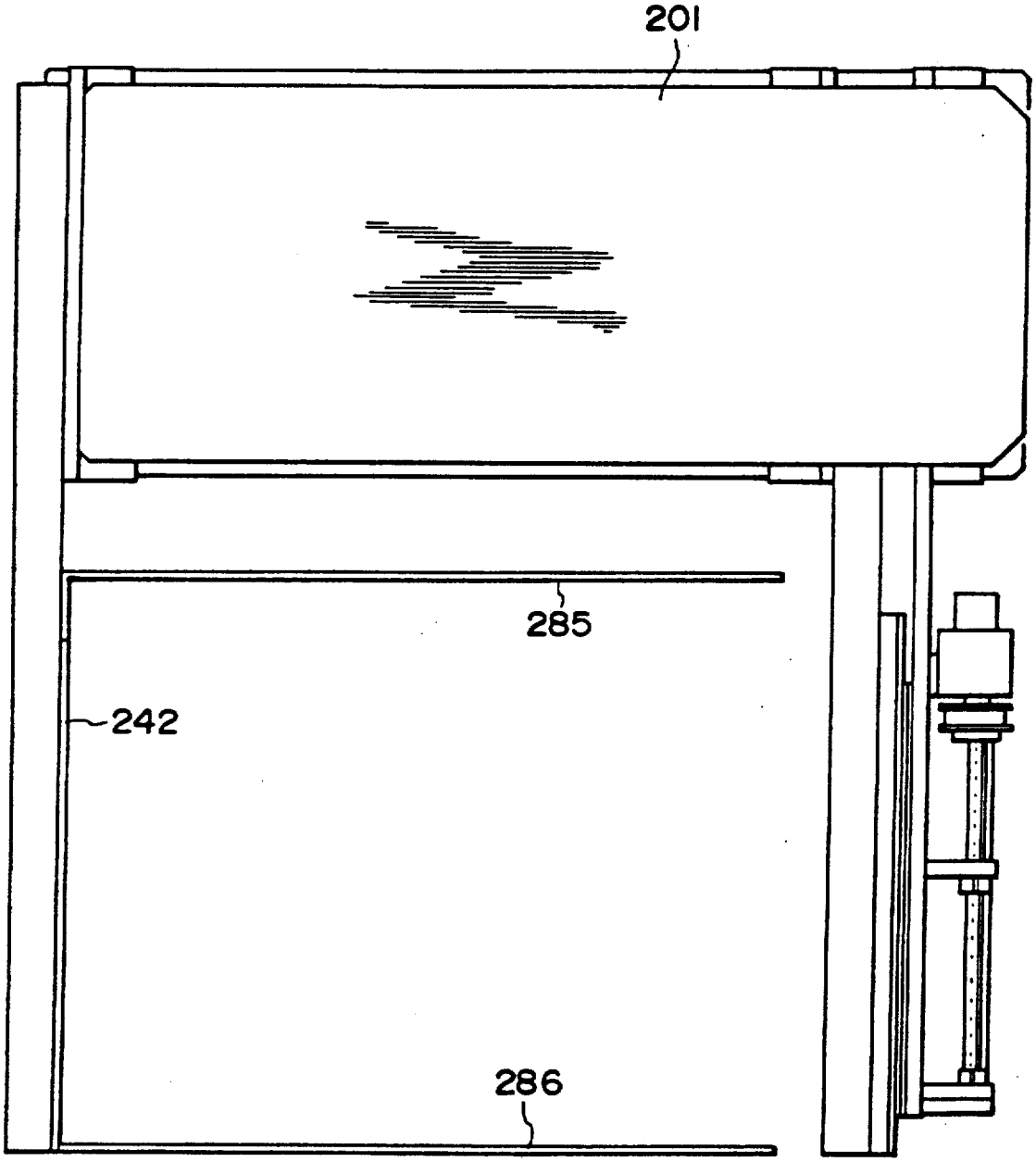
FIG. 31 is a plan view showing an embodiment in which the rear ejector plate is provided on both sides with covers.

FIG. 31 shows another embodiment of the rear ejector plate 242 in which said rear ejector plate 242 is provided on both sides with sheet-metallic covers 285, 286 adapted to be actuated together with the rear ejector plate 242 into the case 50 in order to hold the ampules (a) laterally from both sides. This embodiment allows the ampules (a) to be further smoothly transferred, because there occurs no friction between the laterally outermost ampules (a) and the side plates 60, 61 of the case 50 and/or the guard rails 283, 284.

Figure 32:
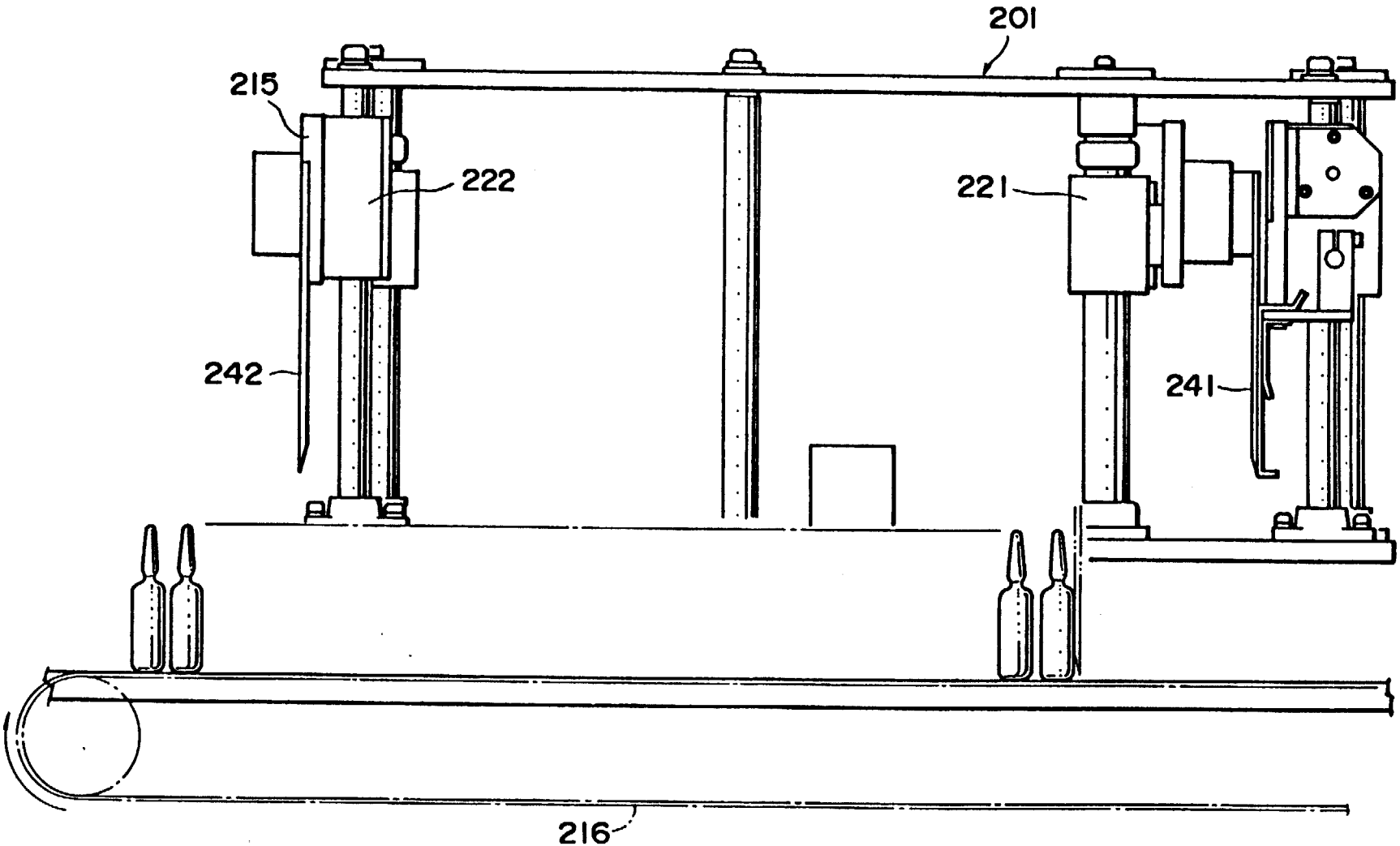
FIG. 32 is a front view showing the state in which the front and rear ejector plates have been removed upon completion of the ampule movement shown by FIG. 30.
Figure 33:
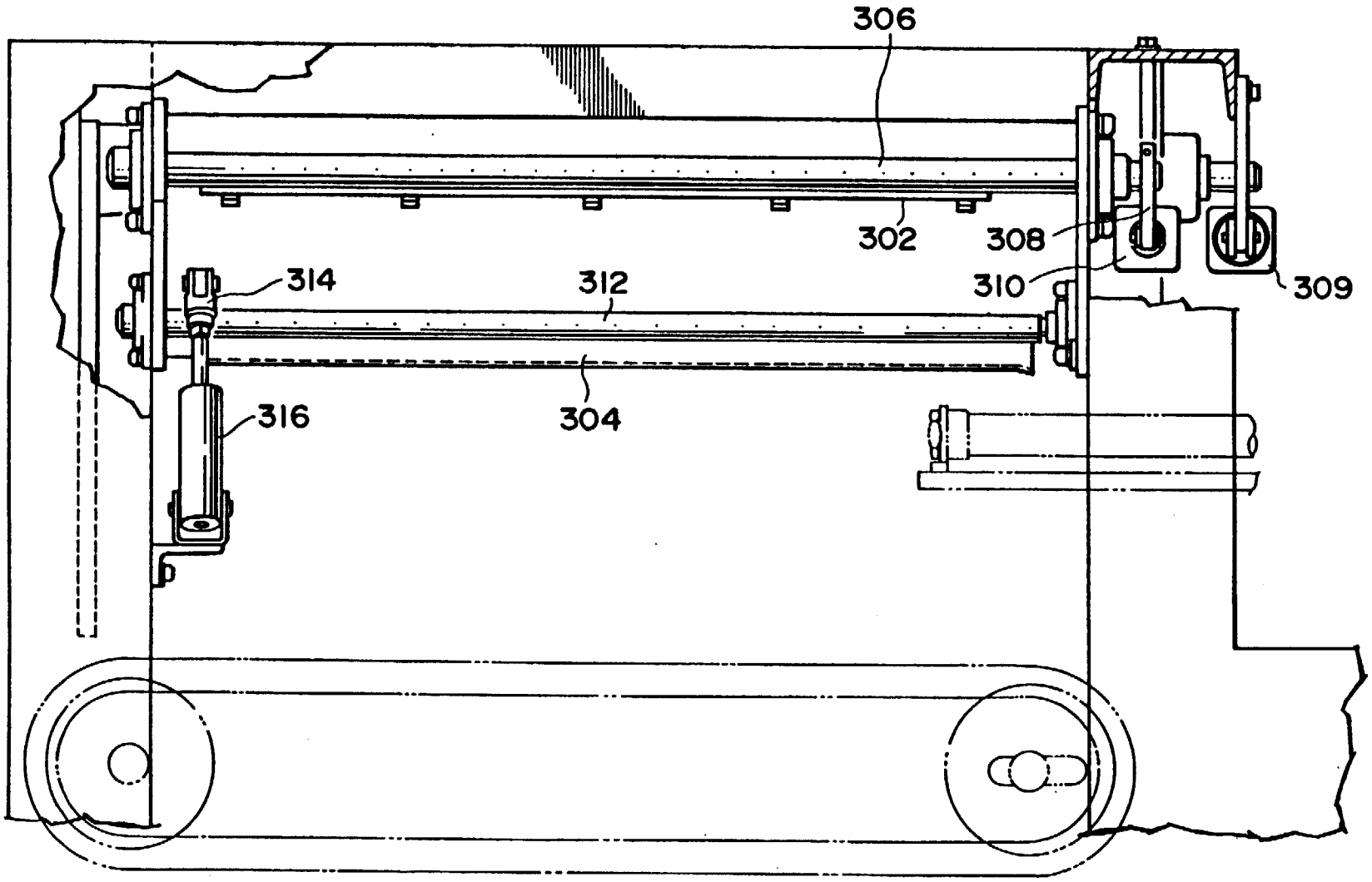
FIG. 33 is a right side view illustrating how the upper and lower levers of the case discharging station operate.

Once all the ampules (a) have been transferred onto the conveyor 216, the rodless cylinder 222 is actuated to lift the third plate 215 and thereby to pull the rear ejector plate 242 out of the case 50. Then, the electromotor 241 is actuated to drive the movable block 201 forward at a velocity higher than that of the conveyor 216 while the rodless cylinder 221 is actuated to lift the second plate 214 and thereby to pull the front ejector plate 241 upward to a position above and in front of the forefront row of the ampules (a) as seen in FIG. 32.

Such procedure as mentioned just above that the front ejector plate 241 is pulled up while this ejector plate 241 is driven forward at a velocity higher than that of the conveyor 216 is based on a requirement that a friction causing the ampules of the forefront row to fall down should not occur between these ampules (a) and the front ejector plate being pulled up.

Thus, the ampules (a) are left free on the conveyor 216 and transported by this conveyor 216.

Thereafter the electromotor 208 is reversely actuated to bring the movable block 210 back to a position above the emptied case 50 and the cylinder 220 is actuated to lower the first plate 213 and thereby to bring the shutter 62 into engagement with the respective vertical slots 64, 65 of the respective case side plates 60, 61 of the case 50.

This insertion of the shutter 62 is smoothly performed by the rollers 273, 274 provided on the top surfaces of the respective guides 270, 271. Thereupon, the electromotor 234 of the first plate 213 is reversed so as to open the chuck 233 and thereby to release the shutter, and then the cylinder 238 is actuated to lift the first plate 213 again. Then, the cylinder 254 associated with the thrusting device 250 is actuated to bring the case 50 back onto the lifter 153 and to release the clamps 255, 256.

With the emptied case 50 having been placed on the lifter 153, the cylinder 162 is actuated to lower the lifter 153 and thereby to bring the case 50 back into the apparatus proper 11.

In front of the case 50 which has been brought back into the apparatus proper 11, there is provided a laterally slidable arm 170 as shown by FIG. 16. The laterally slidable arm 170 is adapted to be moved back and forth by actuation of the rodless cylinder 171.

Reference numerals 172, 173 designate switches adapted to detect when said laterally slidable arm 170 has reached front or rear extreme positions and reference numerals 174, 175 designate a pair of guide rail used to guide the case 50 so that said case 50 can be maintained properly oriented during transfer thereof backward to the case discharging station 300.

As will be apparent from FIG. 11, the case discharging station 300 is provided with a pair of upper levers 301, 302 inwardly extending toward each other and a pair of lower levers 303, 304 also inwardly extending toward each other. The empty case 50 having been laterally transferred by the laterally slidable arm 170 from the lifter 153 within the apparatus proper 11 is adapted to be suspended with its upper flange 73 of the case 50 by the lower levers 303, 304. During such discharging of the empty case 50, the guide 156 is lowered by actuation of the cylinder so that this discharging operation never be obstructed by said guide 156.

Figure 12:
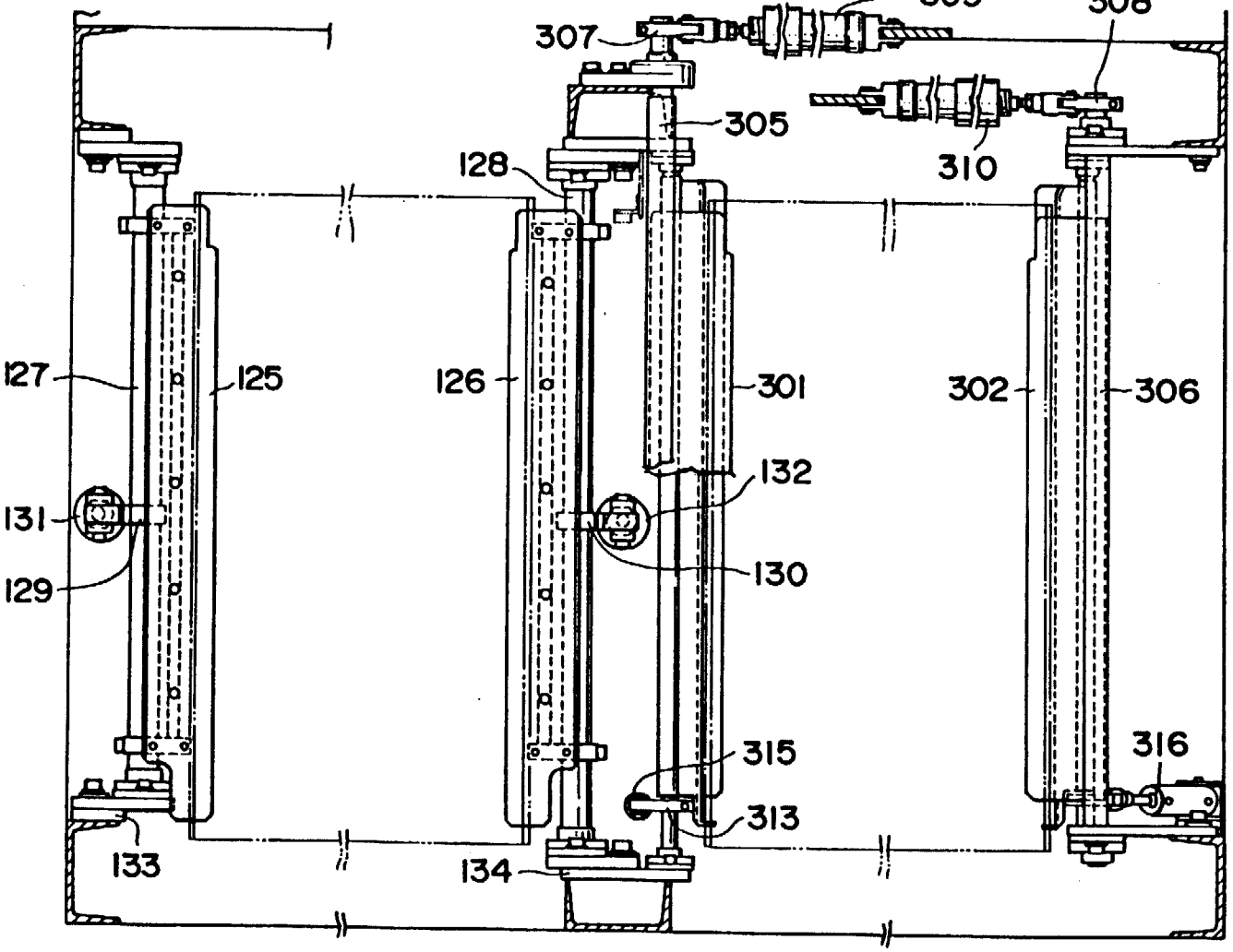
FIG. 12 is a plan view showing the case feeding and discharging stations.
Figure 13:
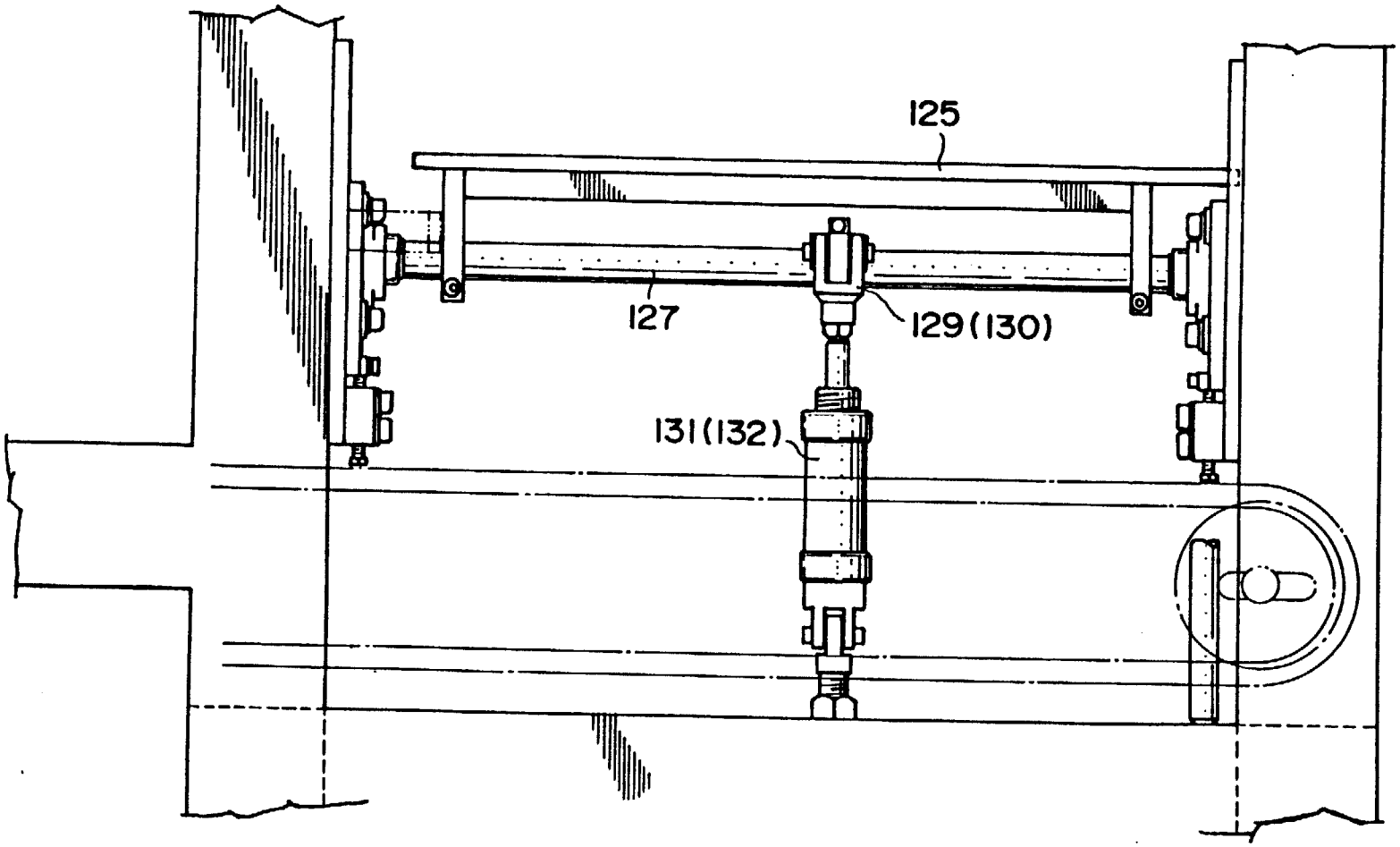
FIG. 13 is a left side view showing how the levers of the case feeding station operate.

The upper levers 301, 302 are mounted on rotatable shafts 305, 306, respectively, and adapted to be opened downward by actuation of cylinders 309, 310 mounted on respective crank arms 307, 308 fixed to front ends of respective said rotatable shafts 305, 306 (See FIGS. 11, 12).

Similarly, the lower levers 303, 304 are mounted on rotatable shafts 311, 312, respectively, and also adapted to be opened downward, as seen in FIG. 11, by actuation of respective cylinders 315, 316 mounted on respective crank arm 313, 314 fixed to rear ends of respective said rotatable shafts 311, 312.

There is provided below the case 50 suspended by these lower levers 303, 304 a lifter 320 along both sides of which a pair of endless belts 321, 322 extend.

Such drive mechanism is shown by FIG. 17, in which the lifter 320 is provided on its underside with a cylinder 323 and guide supports 324, 325.

Said endless belts 321, 322 are in operative association with a drive sprocket 326 and a follower sprocket 327 and driven round by a gear 329 from an electromotor 328.

Figure 34:
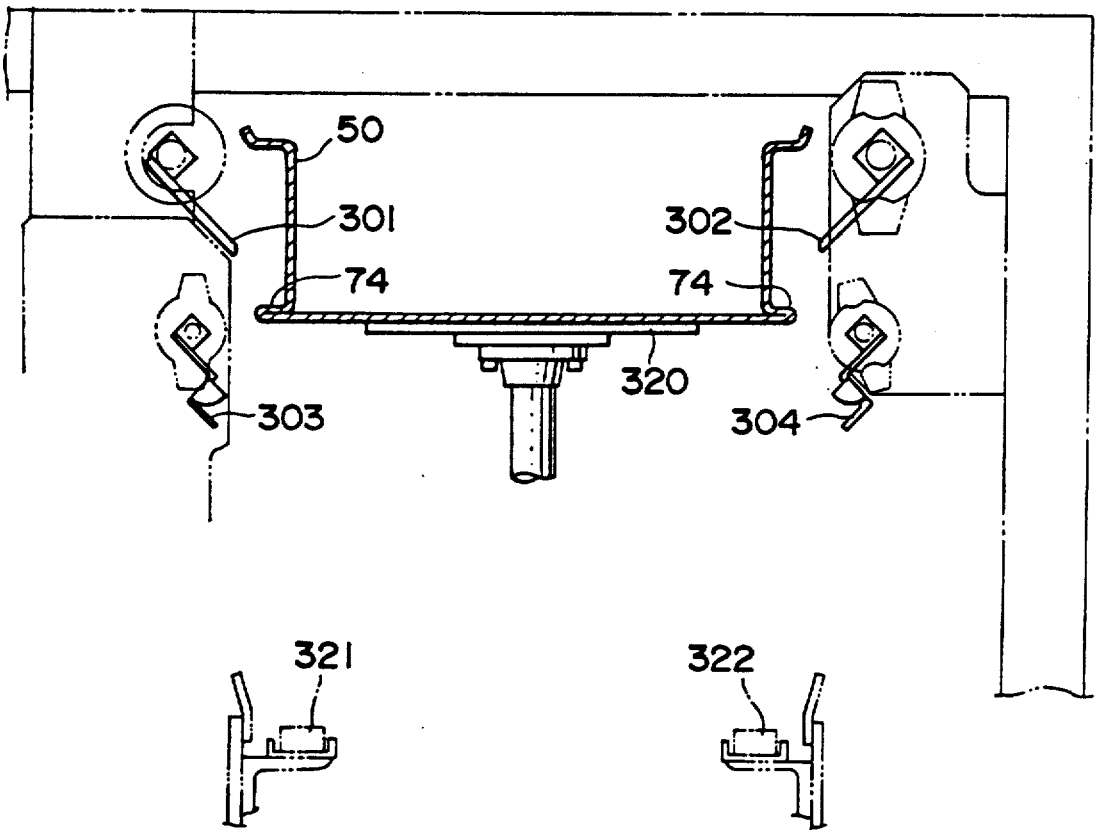
FIG. 34 illustrates the step of transferring the first empty case from the lower levers onto the upper levers.
Figure 35:
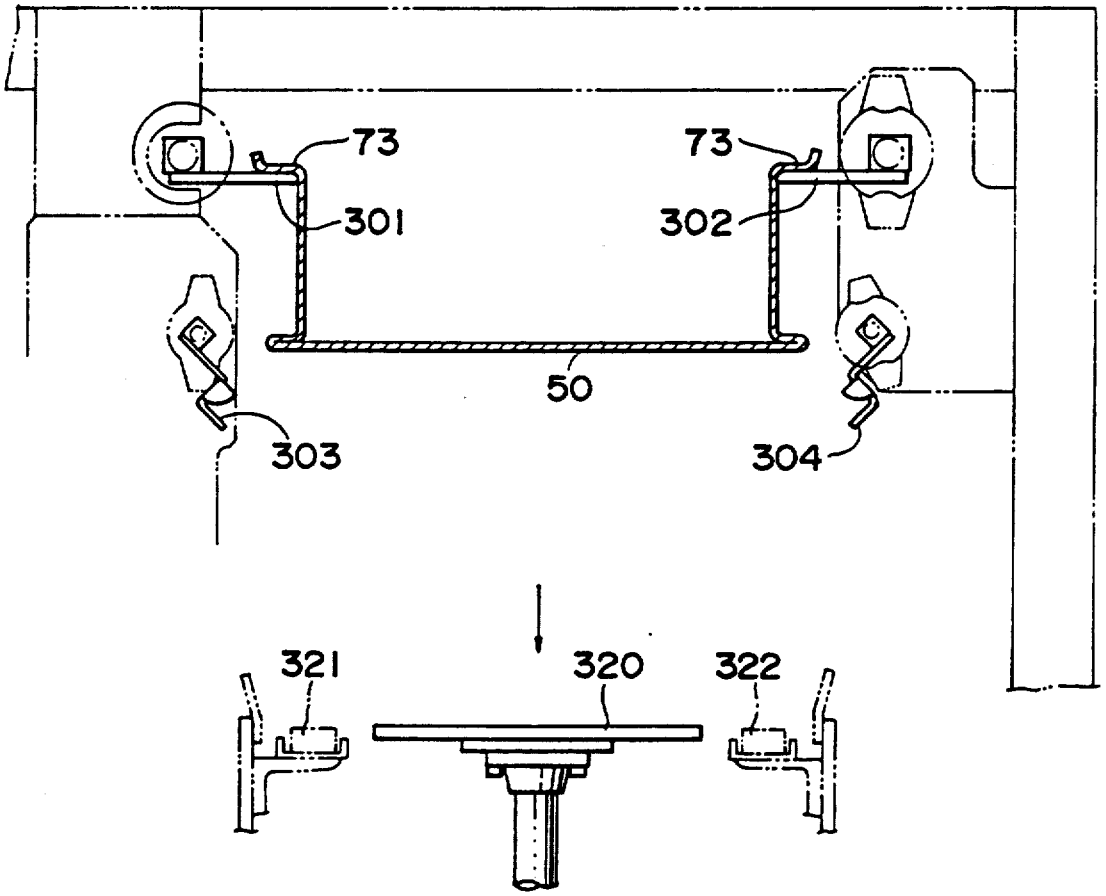
FIG. 35 illustrates the state in which the transfer shown by FIG. 34 has been completed.
Figure 36:
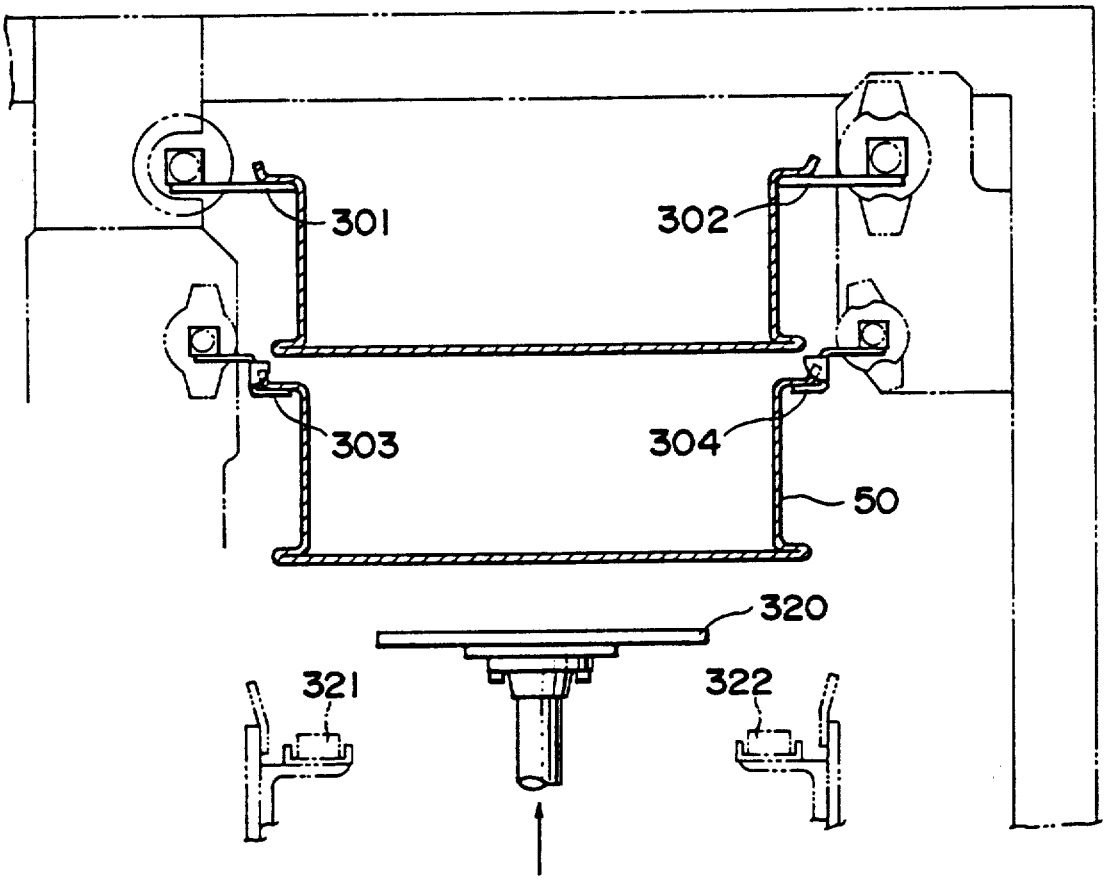
FIG. 36 illustrates the step of conveying the second empty case onto the lower levers.

Immediately after the empty case 50 suspended by the lower levers 303, 304 has been discharged at the case discharging station 300, the lifter 320 rises to lift the next empty case 50, as shown by FIG. 34. During this, the lower levers 303, 304 are opened downward in order to avoid any interference of these lower levers 303, 304 with the lower flange 74 of said case 50 being lifted by the lifter 320. Now the upper levers 301, 302 are inwardly swung toward the case 50 having been lifted and then the lifter 320 is lowered again, leaving the case 50 with the upper flange 73 thereof supported by the upper levers 301, 302, as shown by FIG. 35.

Figure 37:
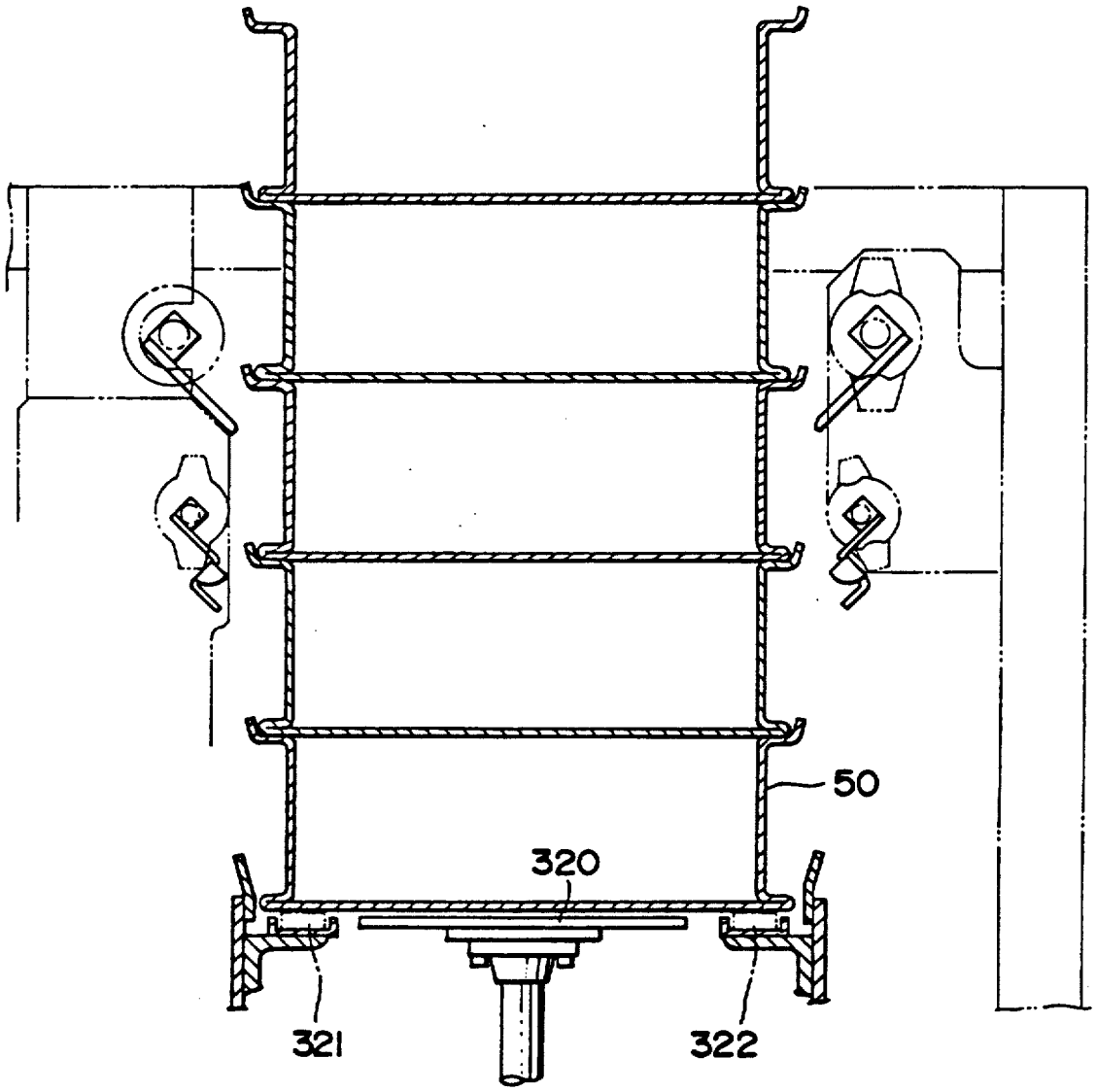
FIG. 37 illustrates the state in which the multistage-stacked empty cases have been placed on the lifter associated with the case discharging station.

After the following empty case 50 has been horizontally transferred from the lifter 153 and suspended by the lower levers 303, 304 inwardly extending again at this time point, the lifter 320 rises again to lift this case 50. The same procedure may be repeated to support a stack of the empty cases 50 on the upper levers 301, 302, as shown by FIG. 37.

After a stack of, for example, ten empty cases 50 has accumulated on the upper levers 301, 302, the lifter 320 rises to receive these stacked empty cases 50, then both the upper levers 301, 302 and the lower levers 303, 304 are downwardly opened and said lifter 320 is lowered again. The stacked empty cases 50 are thereby transferred onto the endless belts 321, 322 and actuation of the electromotor 328 causes said endless belts 321, 322 to carry these empty cases 50 away rearwardly out of the apparatus proper 11.

While the invention has been particularly shown and described with reference to preferred embodiment thereof, it will be understood by those skilled in the art that the foregoing and other changes in form and details can be made therein without departing from the spirit and scope of the invention.

What is claimed is:

1. Method for taking upright articles such as ampules out from a case, said method comprising steps of:
   1) inserting front and rear ejector plates into the case for storage of the upright articles such as the ampules, said case having a pair of laterally opposite side plates formed with a pair of vertical slots, respectively, into which a shutter is removably engaged;
   2) removing the shutter from said case;
   3) horizontally moving said front and rear ejector plates toward conveying means such as a conveyor; and
   4) removing said front and rear ejector plates from said case after these ejector plates have been moved to their positions above said conveying means such as the conveyor.

2. Method for taking upright articles such as ampules out from a case as recited in claim 1, further comprising a step of, prior to insertion of the front ejector plate, forming a gap between a forefront row of the upright articles such as the ampules and the shutter so as to facilitate insertion of the front ejector plate.

3. Method for taking upright article such as ampules out from a case as recited in claim 2, wherein said step of facilitating insertion of the front ejector plate further includes a step of erecting the shutter having been previously inclined forward with respect to a direction in which the cases are transported and thereby forming a gap between the forefront row of the upright articles such as the ampules and the shutter.

4. Method for taking upright articles such as ampules out from a case as recited in claim 1, further comprising a step of, prior to insertion of the rear ejector plate, pushing a rearmost row of the upright articles such as the ampules forward.

5. Method for taking upright articles such as ampules out from a case as recited in claim 4, further comprising a step of, prior to pushing the rearmost row of the upright articles such as the ampules forward, slightly shifting the front ejector plate forward in the direction of transport after said front ejector plate has been inserted.

6. Method for taking upright articles such as ampules out from a case as recited in claim 1, wherein said step of removing the front and rear ejector plates from the case for storage of the upright articles such as the ampules comprises a step of removing the front ejector plate after the rear ejector plate has been removed.

7. Method for taking upright articles such as ampules out from a case as recited in claim 1, said step of removing the front ejector plate comprises a step of removing the front ejector plate while said front ejector plate is moved at a velocity higher than that of the conveying means such as the conveyor.

8. Apparatus for taking out and conveyance of upright articles such as ampules from a case, said apparatus comprising:

the case for storage of the upright articles such as the ampules, said case having a pair of laterally opposite side plates formed with a pair of vertical slots, respectively, into which a shutter is removably engaged;

front and rear ejector plates adapted to be removably inserted into said case;

a chuck used to remove said shutter from said case;

means for horizontally moving said front and rear ejector plates; and means for conveyance of said upright articles such as the ampules.

9. Apparatus for taking out and conveyance of upright articles such as ampules from a case as recited in claim 8, wherein said vertical slots of the case for storage of the upright articles such as the ampules are respectively formed with pointed protrusions defining notches into which the shutter is engaged so as to incline the shutter forward with respect to the direction in which the cases are transported.

10. Apparatus for taking out and conveyance of upright articles such as ampules from a case as recited in claim 9, wherein a rear side plate of the case for storage of the upright articles such as the ampules is provided on its inner side with a pusher plate adapted to push the ampules forward.

11. Apparatus for taking out and conveyance of upright articles such as ampules from a case as recited in claim 9, further comprising control means adapted to lift said chuck slightly so that said shutter can be disengaged from said notches and engaged into the other notches of said vertical slots to be vertically oriented.

12. Apparatus for taking out and conveyance of upright articles such as ampules from a case, said apparatus comprising:

the case for storage of the upright articles such as the ampules, said case having a pair of laterally opposite side plates formed with a pair of vertical slots, respectively, into which a shutter is removably engaged;

a case feeding station providing with a feeding conveyor which transport said case;

a case taking out station including:

1) front and rear ejector plates adapted to be removably inserted into the case;

2) a chuck adapted to remove a shutter from said case; and 3) means for horizontally moving said front and rear ejector plates; and a case discharging station including;

means for conveyance of said upright articles such as the ampules; and means for discharging the empty cases having completed transport of the upright articles such as the ampules.

13. Apparatus for taking out and conveyance of upright articles such as ampules from a case as recited in claim 12, wherein the case for storage of the upright articles such as the ampules are laterally provided with flanges.

14. Apparatus for taking out and conveyance of upright articles such as ampules from a case as recited in claim 13, wherein said case feeding station further comprises a lifter adapted to lift the stacked cases, levers adapted to be engaged with the flanges of the second case from the bottom and thereby to suspend this case, and a feeding conveyor for the case left on the lifter.

15. Apparatus for taking out and conveyance of upright articles such as ampules from a case as recited in claim 13, wherein said means for discharging the empty cases having completed transport of the upright articles such as the ampules comprises a lifter adapted to lift the case one by one and levers adapted to suspend said case having been lifted.

* * * * *